US006117611A

United States Patent [19]

Ito

[11] Patent Number: 6,117,611

[45] Date of Patent: Sep. 12, 2000

[54] IMAGE FORMING METHOD OF A SILVER HALIDE PHOTOGRAPHIC LIGHT-SENSITIVE MATERIAL

[75] Inventor: Hirohide Ito, Hino, Japan

[73] Assignee: Konica Corporation, Tokyo, Japan

[21] Appl. No.: 09/459,469

[22] Filed: Dec. 13, 1999

[30] Foreign Application Priority Data

Dec. 14, 1998 [JP] Japan ..... 10-354445

[51] Int. Cl.[7] ..... G03C 5/29

[52] U.S. Cl. ..... 430/264; 430/440; 430/446

[58] Field of Search ..... 430/264, 440, 430/446

[56] References Cited

U.S. PATENT DOCUMENTS

| | | | |
|---|---|---|---|
| 1,623,499 | 4/1927 | Sheppard et al. | 430/599 |
| 2,244,043 | 6/1941 | Baxter | 12/127 |
| 2,304,025 | 12/1942 | Schneider et al. | 430/469 |
| 2,588,765 | 3/1952 | Robijns | 430/502 |
| 2,732,305 | 1/1956 | Richman et al. | 430/514 |
| 2,767,172 | 10/1956 | Katz et al. | 546/175 |
| 2,767,173 | 10/1956 | Katz | 546/175 |
| 2,767,174 | 10/1956 | Katz et al. | 546/175 |
| 2,767,176 | 10/1956 | Erickson | 544/64 |
| 2,870,015 | 1/1959 | Allen et al. | 430/614 |
| 2,976,148 | 3/1961 | Walford | 430/529 |
| 3,042,222 | 7/1962 | Lehmann | 212/311 |
| 3,042,522 | 7/1962 | Ben-Ezra | 430/359 |
| 3,080,317 | 3/1963 | Tallet et al. | 430/401 |
| 3,121,060 | 2/1964 | Duane | 430/599 |
| 3,206,311 | 9/1965 | Campbell et al. | 430/496 |
| 3,489,567 | 1/1970 | McGraw | 430/531 |
| 3,502,473 | 3/1970 | Snellman et al. | 430/538 |
| 3,933,516 | 1/1976 | Mackey | 430/530 |
| 4,004,927 | 1/1977 | Yamamoto et al. | 430/523 |
| 4,047,958 | 9/1977 | Yoneyama et al. | 430/527 |
| 5,229,248 | 7/1993 | Sanpei et al. | 430/264 |
| 5,264,337 | 11/1993 | Maskasky | 430/567 |
| 5,314,798 | 5/1994 | Brust et al. | 430/567 |
| 5,320,958 | 6/1994 | Inouye et al. | 435/194 |

FOREIGN PATENT DOCUMENTS

| | | |
|---|---|---|
| 4-214551 | 8/1992 | Japan . |
| 10-10680 | 1/1998 | Japan . |

*Primary Examiner*—Hoa Van Le

*Attorney, Agent, or Firm*—Finnegan, Henderson, Farabow, Garrett & Dunner, L.L.P.

[57] ABSTRACT

An image forming method of a silver halide photographic light-sensitive material is disclosed. The silver halide photographic light-sensitive material is exposed to a laser beam light, while said silver halide photographic light-sensitive material is conveyed with rollers at 15 to 100 mm/sec., and processed with a developer composition containing a developing agent represented by formula (A). The silver halide photographic light-sensitive material contains at least an organic contrast enhancing agent, the impedance of at least one side of said silver halide photographic light-sensitive material is from $4\times10^5$ to $10^{20}$ Ω, Formula (A)

(defined in the specification)

9 Claims, No Drawings

IMAGE FORMING METHOD OF A SILVER HALIDE PHOTOGRAPHIC LIGHT-SENSITIVE MATERIAL

BACKGROUND OF THE INVENTION

The present invention relates to an image forming method of a silver halide photographic light-sensitive material used in the printing and plate-making field, and specifically to an image forming method of a silver halide photographic light-sensitive material, with no blackened pressure mark caused by abrasion, used in the printing and plate-making field.

Conventionally, as a silver halide photographic light-sensitive material used in the printing and plate-making field (hereinafter referred to as a light-sensitive material), are used photographic techniques in which a super-high contrast image can be obtained. Of these, for example, a light-sensitive material comprising an emulsion containing a hydrazine derivative or an emulsion containing a nucleation accelerating agent is well known. However, there has been a problem that blackened pressure marks caused by abrasion tend to occur, when an image forming method utilizing a high contrast photographic light-sensitive material, specifically an image forming method utilizing the high contrast photographic light-sensitive material in which a nucleation development caused by a hydrazine derivative or the like, is employed.

On the other hand, along with a progress in a digitized prepress process, a film usable for output of image setter has been prevailing. In said image setter, a light-sensitive material is exposed to a laser beam light by scanning said laser beam light and examples of scanning method include an external scanning method, an internal scanning method, a plane scanning method (a capstan method), or the like.

Of these, the plane scanning method is advantageous, from the viewpoint of rapidity and small-size of an apparatus. However, since scanning is carried out by conveying the light-sensitive material when exposed to a laser beam light, the light-sensitive material tends to be subjected to physical stimulation. Therefore, there has been a problem that blackened pressure marks readily occur with the plane scanning method, compared with the external scanning method or the internal scanning method in which scanning is not carried out by conveying the light-sensitive material when exposed to a laser beam light. Specifically, in the case of conveying speed of not less than 15 mm/sec., the occurrence of blackened pressure marks caused by abrasion is marked and improvement of said blackened pressure marks caused by abrasion has been strongly demanded.

With respect to a conventional technique to prevent the said blackened pressure marks caused by abrasion, regulating the kinetic friction coefficient is disclosed in Japanese Patent Publication Open to Public Inspection (hereinafter referred to as JP-A) No. 4-214551. However, according to this technique, sufficient effect is not obtained in the case of conveying speed of not less than 15 mm/sec. when the light-sensitive material is exposed to a laser beam light.

SUMMARY OF THE INVENTION

An object of the present invention is to provide an image forming method of a silver halide photographic light-sensitive material giving no adverse effect to photographic characteristics and to provide an image forming method of a silver halide photographic light-sensitive material without blackened pressure mark caused by abrasion, when said light-sensitive material, specifically when exposed to a laser beam light, is treated.

The invention and its embodiment are described.

An image forming method of a silver halide photographic light-sensitive material comprising a light-sensitive silver halide emulsion layer provided on a support, comprising steps of exposing the silver halide photographic light-sensitive material to a laser beam light, while said silver halide photographic light-sensitive material is conveyed with rollers at 15 to 100 mm/sec., processing the exposed silver halide photographic light-sensitive material with a developer composition containing a developing agent represented by formula (A).

wherein the silver halide photographic light-sensitive material contains at least an organic contrast enhancing agent, the impedance of at least one side of said silver halide photographic light-sensitive material is from $4\times10^5$ to $10^{20}$ Ω, Formula (A)

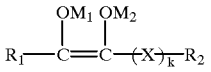

wherein, $R_1$ and $R_2$ each represent a substituted or unsubstituted alkyl group; a substituted or unsubstituted amino group, a substituted or unsubstituted alkoxy group, a substituted or unsubstituted alkylthio group; $R_1$ and $R_2$ may form a ring structure with each other; k represents 0 or 1, and when k is 1, X represents —CO— or —CS—; $M_1$ and $M_2$ each represent a hydrogen atom or an alkali metal.

An image forming method of a silver halide photographic light-sensitive material comprising a light-sensitive silver halide emulsion layer containing at least an organic contrast enhancing agent, wherein the kinetic friction coefficient of an emulsion side of said silver halide photographic light-sensitive material is between 0.10 and 0.35, and said silver halide photographic light-sensitive material is exposed to a laser beam light, while said silver halide photographic light-sensitive material is conveyed with rollers at 15 to 100 mm/sec., subsequently said silver halide photographic light-sensitive material is processed in a developer composition containing a developing agent represented by the following formula (A), Formula (A)

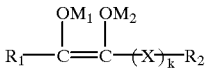

wherein, $R_1$ and $R_2$ each represent a substituted or unsubstituted alkyl group; a substituted or unsubstituted amino group, a substituted or unsubstituted alkoxy group, a substituted or unsubstituted alkylthio group; $R_1$ and $R_2$ may form a ring structure with each other; k represents 0 or 1, and when k is 1, X represents —CO— or —CS—; $M_1$ and $M_2$ each represent a hydrogen atom or an alkali metal.

An image forming method of a silver halide photographic light-sensitive material comprising a light-sensitive silver halide emulsion layer containing at least an organic contrast enhancing agent, wherein the impedance of at least one side of said silver halide photographic light-sensitive material is from $4\times10^5$ to $10^{20}$ Ω, and said silver halide photographic light-sensitive material is exposed to a laser beam light, while said silver halide photographic light-sensitive material is conveyed with rollers at 15 to 100 mm/sec., subsequently said silver halide photographic light-sensitive material is processed in a developer composition containing a developing agent represented by the above-mentioned formula (A).

The image forming method of claim 1 wherein the kinetic friction coefficient of an emulsion side of said silver halide photographic light-sensitive material is 0.10 to 0.35 The outermost layer of the emulsion side contains a lubricant. The preferable example of the lubricant is alkylpolysiloxane. The silver halide photographic light-sensitive material preferably comprises polyhydroxybenzene compound.

The silver halide photographic light-sensitive material comprises an electro-conductive layer. The electro-conductive layer is provided adjacent to the support.

The preferably example of the contrast enhancing organic agent hydrazine derivatives and tetrazolium compounds.

The rollers for conveying the silver halide photographic light-sensitive material are preferably composed of gum.

DETAILED DESCRIPTION OF THE INVENTION

The present invention will now be detailed.

The silver halide photographic light sensitive material of the invention comprises a support and an emulsion layer containing a light sensitive silver halide emulsion. The silver halide photographic light sensitive material contains an organic contrast enhancing agent. The silver halide photographic light sensitive material may also comprise another layer than the emulsion layer. As the example of the layer includes a protective layer, a subbing layer and a backing layer. The backing layer is a layer provided on the reverse side of a side having the emulsion layer with reference to the support.

The silver halide photographic light sensitive material preferably comprises an electro-conductive layer. The electro-conductive layer may be the emulsion layer or another layer. It is preferably an adjacent layer to the support, and the electro-conductive layer may be provided between the support and the emulsion layer or subbing layer or the backing layer may be the electro-conductive layer.

The organic contrast enhancing agent may be contained in the emulsion layer or a layer adjacent to the emulsion layer.

In the present invention, preferred examples of contrast enhancing organic agents include hydrazine derivatives and tetrazolium compounds, described in JP-A No. 10-10680, being a 5- or 6-membered nitrogen containing heterocyclic derivative. Of these, preferred one is a hydrazine derivative.

According to the present inventive method, a high contrast image can be formed employing the above-mentioned contrast enhancing organic agent, and a slope (γ) of characteristic curve between density of 1.0 and density of 3.0 obtained for an image, which is produced by exposing and developing the light-sensitive material of the present invention, can be between 10 and 100.

An example of hydrazine derivative is represented by the following formula (H).

Formula (H)

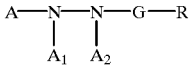

In the formula (H), A represents an aryl group or a heterocyclic group containing therein a sulfur atom or oxygen atom; G represents a $—(CO)_n—$ group, a sulfonyl group, a sulfoxy group, a $—P(=O)R_{52}$ group or an iminomethylene group, in which n is 1 or 2; both of $A_1$ and $A_2$ represent hydrogen atoms, or one of $A_1$ and $A_2$ represents a hydrogen atom and the other represents a substituted or unsubstituted alkylsulfonyl group, or a substituted or unsubstituted acyl group; R represents a hydrogen atom, or a substituted or unsubstituted alkyl group, alkenyl group, aryl group, alkoxy group, alkenyloxy group, aryloxy group, heterocyclicoxy group, amino group, carbamoyl group or oxycarbonyl group, and $R_{52}$ represents a substituted or unsubstituted alkyl group, alkenyl group, alkynyl group, aryl group, alkoxy group, alkenyloxy group, alkynyloxy group, aryloxy group, or amino group.

Among the compounds represented by the above-mentioned general formula (H), the compound represented by the following general formula (Ha) is particularly preferable.

Formula (Ha)

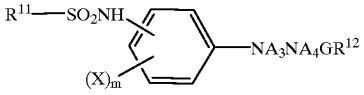

In the formula (Ha), $R^{11}$ represents an aliphatic group (e.g., octyl group, and decyl group); an aromatic group (e.g., phenyl group, 2-hydroxylphenyl group, chlorophenyl group); or a heterocyclic group (e.g., a pyridyl group, a thienyl group, a furyl group); and these groups may be substituted with an appropriate substituent. Further, it is also preferable that $R^{11}$ contains at least one ballast group or a silver halide adsorption-accelerating group.

As a diffusion-proof group, ballast groups which are commonly used in immobile photographic additives such as couplers are preferable, and as such ballast groups, for example, an alkyl group, an alkenyl group, an alkynyl group, an alkoxy group, a phenyl group, a phenoxy group, an alkylphenoxy group, etc., which are relatively photographically inert and consist of carbon atoms of not less than 8, are cited.

The silver halide adsorption-accelerating agent includes, for example, a thiourea group, a thiourethane group, a mercapto group, a thioether group, a thione group, a heterocyclic group, a thioamide heterocyclic group, a mercapto heterocyclic group, or those adsorbing groups disclosed in JP-A No. 64-90439, etc.

In the general formula (Ha), X represents a group which is capable of being substituted on a phenyl group, m represents an integer of 0 to 4, provided when m is 2 or more, X may be the same or different.

In the formula (Ha), $A_3$ and $A_4$ each are identical to $A_1$ and $A_2$ of the formula (H) respectively, and it is preferred that both $A_3$ and $A_4$ are a hydrogen atom.

In the formula (Ha), G represents a carbonyl group, a sulfonyl group, a sulfoxy group, a phosphoryl group or an iminomethylene group, while preferable G is a carbonyl group.

In the formula (Ha), examples of $R^{12}$ include a hydrogen atom, a substituted or unsubstituted alkyl group, an alkenyl group, an alkynyl group, an aryl group, a heterocyclic group, an alkoxy group, a hydroxy group, an amino group, a carbamoyl group, and an oxycarbamoyl group. Preferable examples of $R^{12}$ include a substituted alkyl group in which a carbon atom being substituted with G is substituted with at least an electron withdrawing group, —$COOR^{13}$, and —$CON(R^{14})(R^{15})$($R^{13}$ represents an alkynyl group or a saturated heterocyclic group, $R^{14}$ represents a hydrogen atom, an alkyl group, an alkenyl group, an alkynyl group, an aryl group or a heterocyclic group, $R^{15}$ represents an alkenyl group, an alkynyl group, a saturated heterocyclic group, a hydroxy group or an alkoxy group). A preferable substituted alkyl group is substituted with two electron withdrawing groups, and a more preferable one is substituted with three electron withdrawing groups. Substituents on a carbon atom of $R^{12}$ substituted with G preferably include those of which σp value is not less than 0.2, and those of which σm is not less than 0.3, for example, examples of those substituents include a halogen atom, a cyano group, a nitro group, a nitrosopolyhaloalkyl group, a ployhaloaryl group, an alkylcarbonyl group, an arylcarbonyl group, a formyl group, an alkyloxycarbonyl group, an aryloxycarbonyl group, an alkylcarbonyloxy group, a carbamoyl group, an alkylsulfinyl group, an arylsulfinyl group, an alkylsulfonyl group, an aryl sulfonyl group, an alkylsulfonyloxy group, an arylsulfonyloxy group, a sulfamoyl group, a phosphino group, a phosphineoxide group, a phosphonic acid ester group, a phosphonic acid amide group, an arylazo group, an amidino group, an ammonio group, a sulfonio group, and electron deficient heterocyclic groups.

$R^{12}$ of the formula (Ha) preferably include a fluorine substituted alkyl group, a mono-fluoromethyl group, or tri-fluoromethyl group.

Exemplified compounds represented by the formula (H) will be illustrated below, but the present invention is not limited to these examples.

H-1

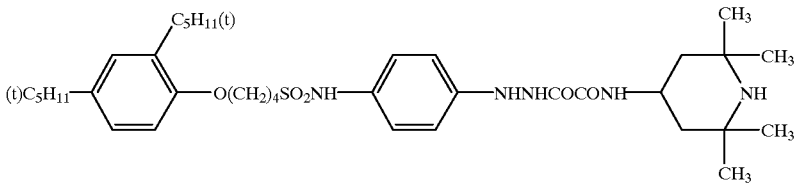

H-2

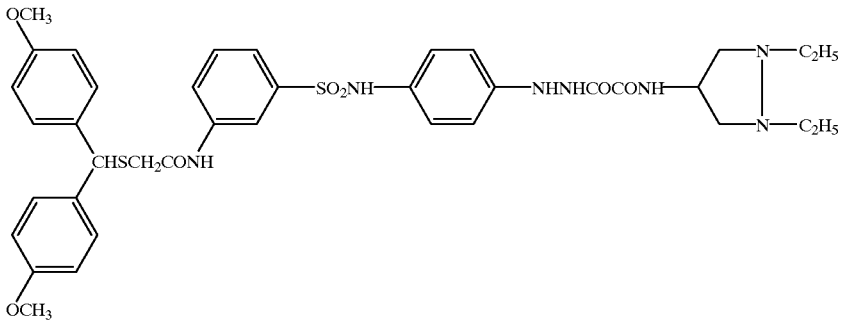

H-3

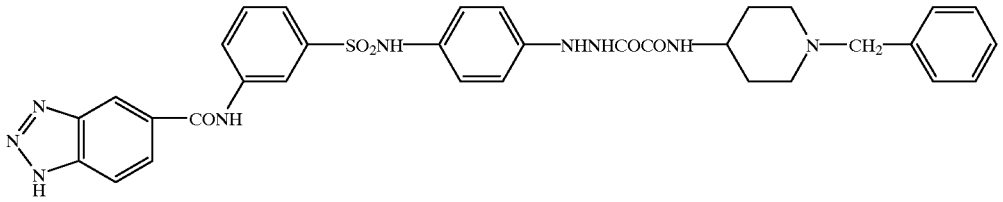

H-4

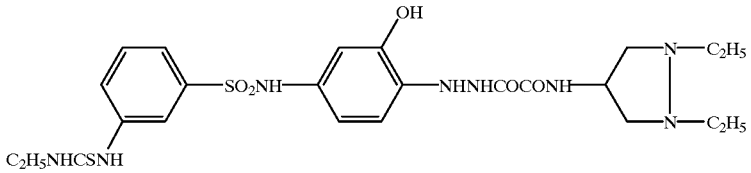

H-5

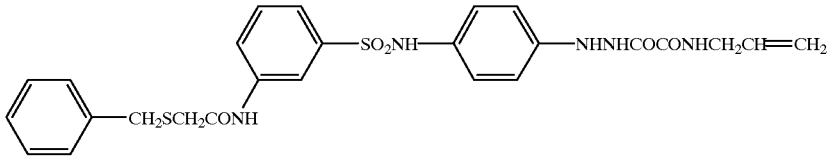

-continued
H-6
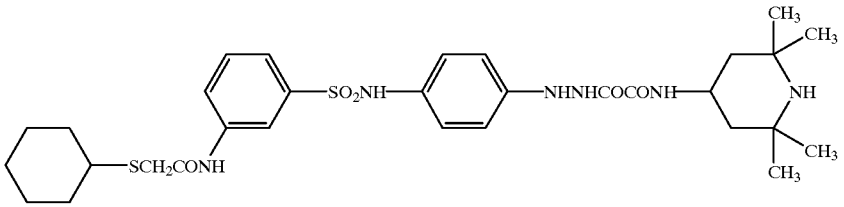
H-7
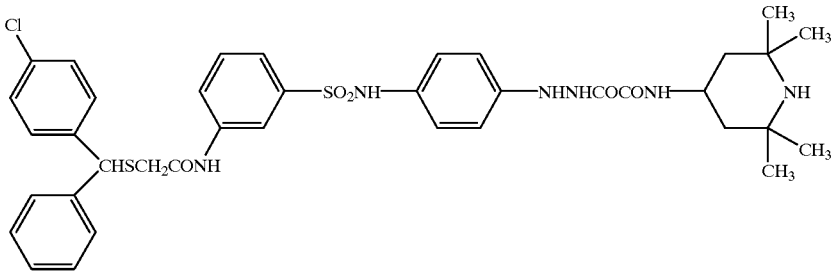
H-8
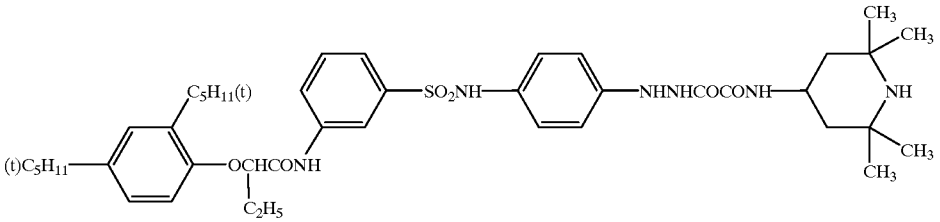
H-9
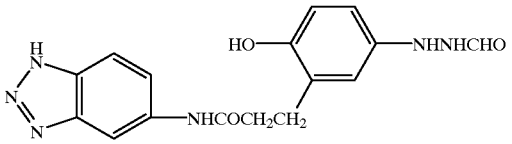
H-10
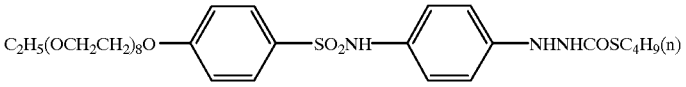
H-11
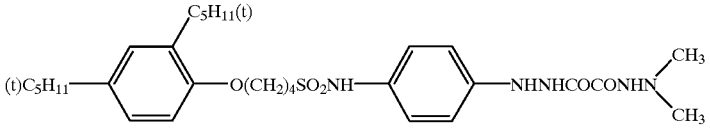
H-12
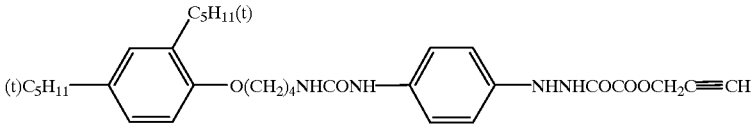
H-13
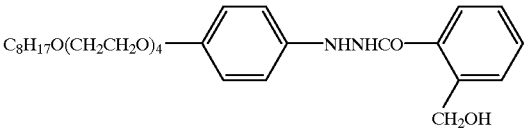

-continued
H-14
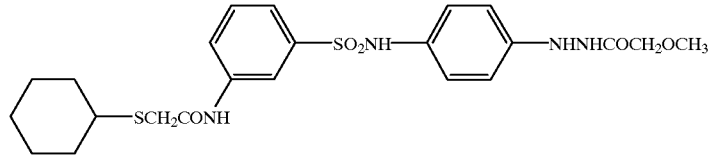
H-15
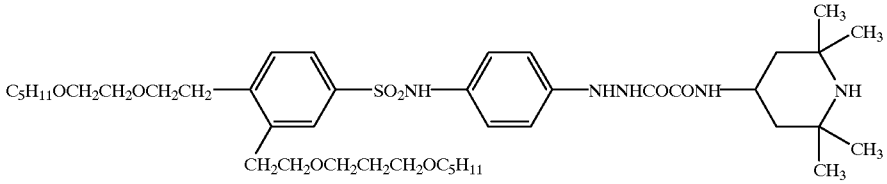
H-16
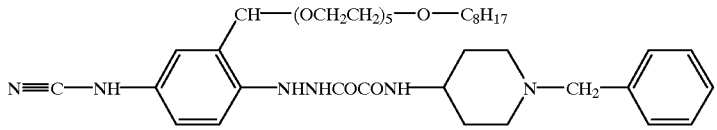
H-17
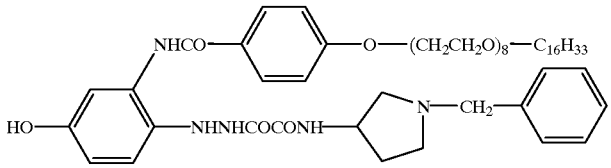
H-18
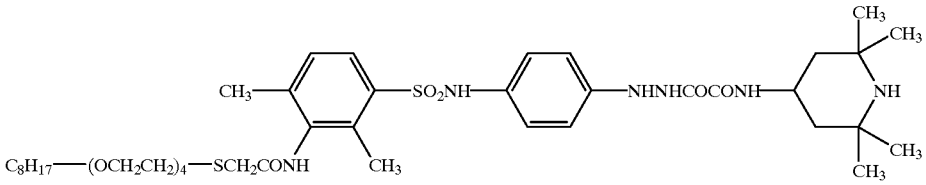
H-19
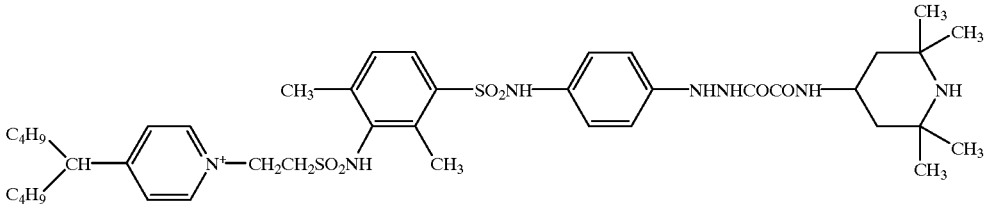
H-20
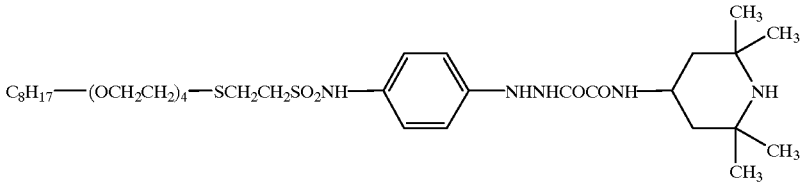
H-21
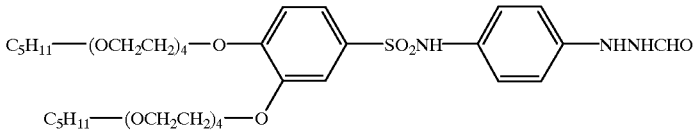

-continued
H-22
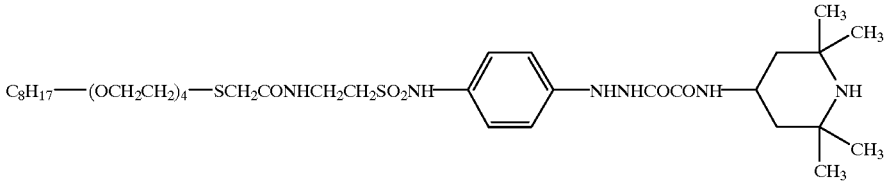
H-23
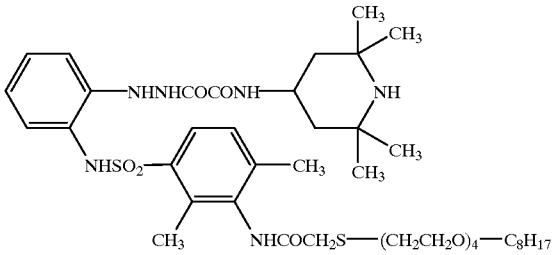
H-24
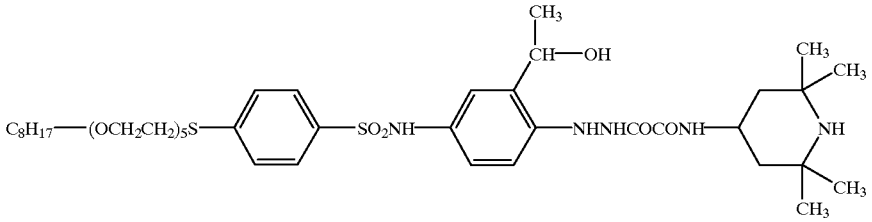
H-25
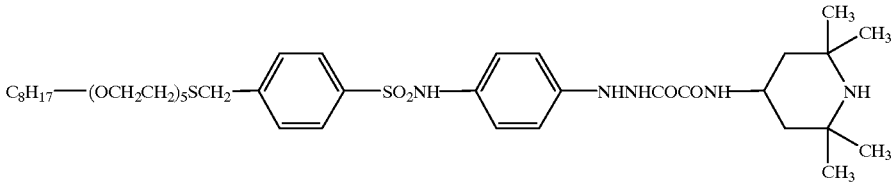
H-26
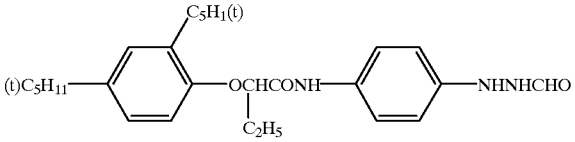
H-27
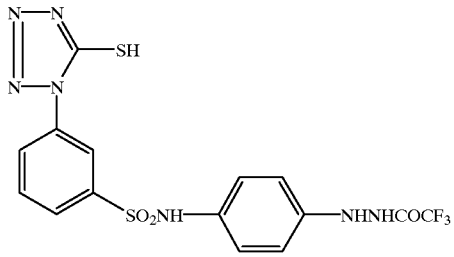
H-28
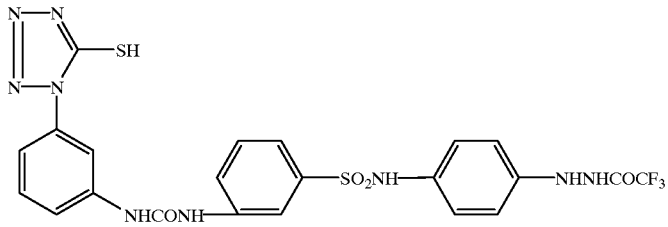

-continued
H-29
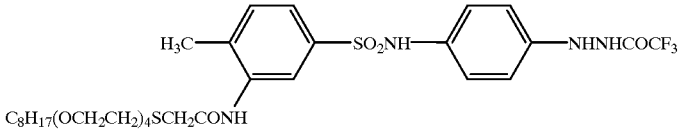
H-30
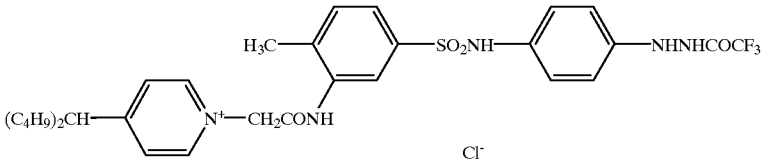
H-31
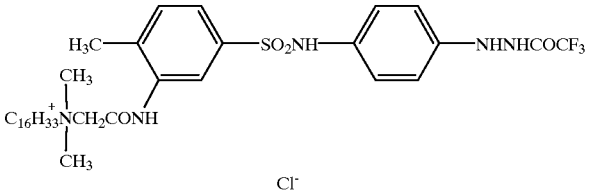
H-32
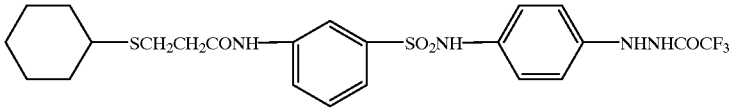
H-33
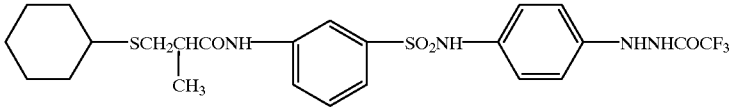
H-34
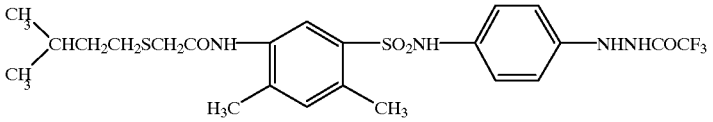
H-35
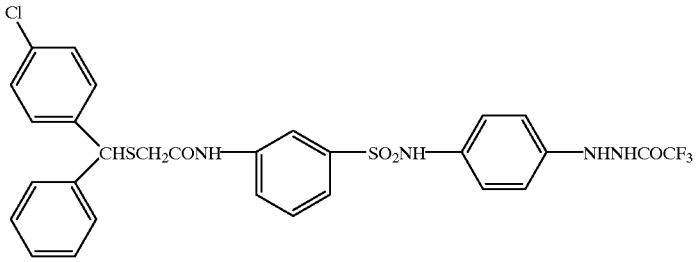
H-36
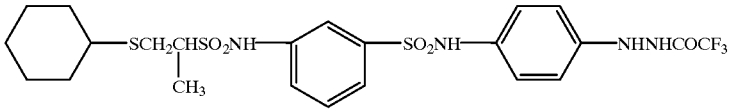

-continued
H-37
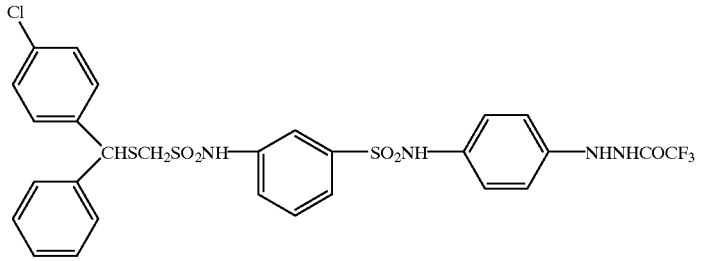
H-38
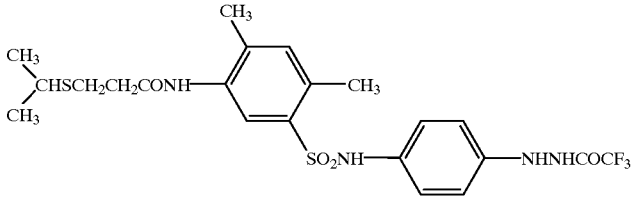
H-39
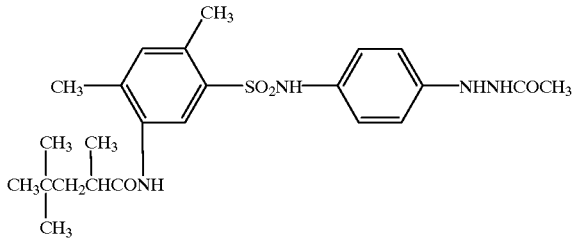
H-40
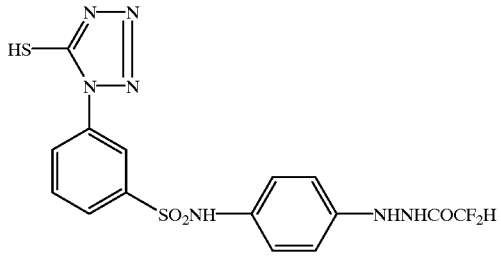
H-41
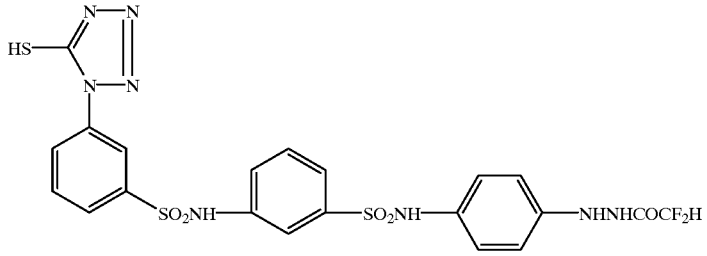
H-42
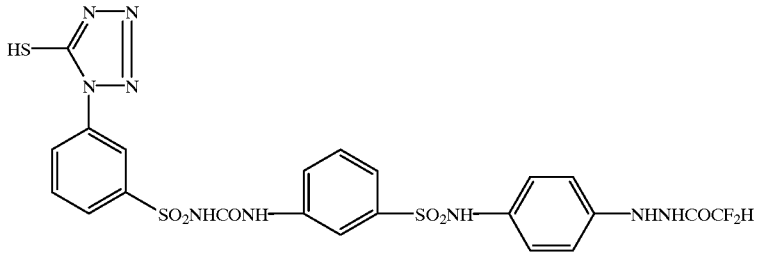

-continued
H-43
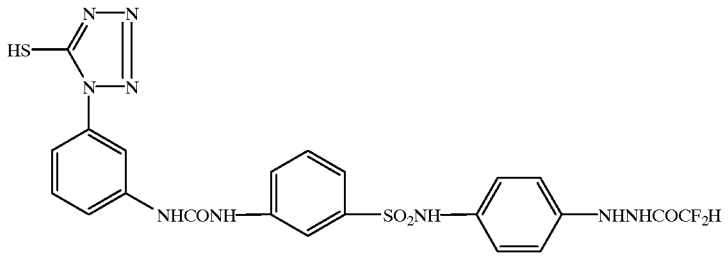
H-44
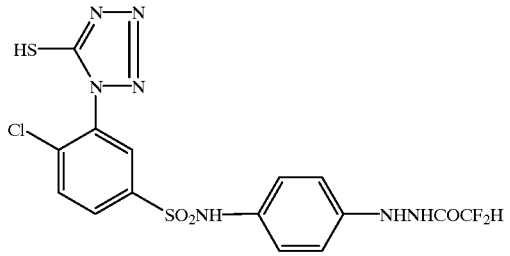
H-45
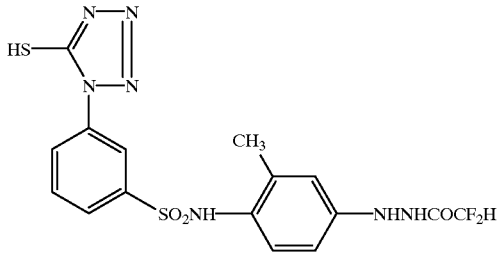
H-46
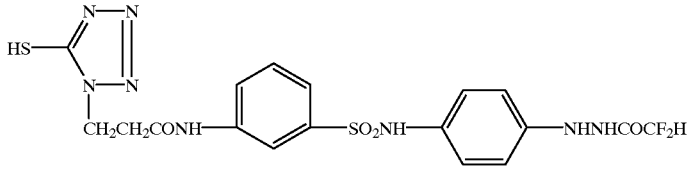
H-47
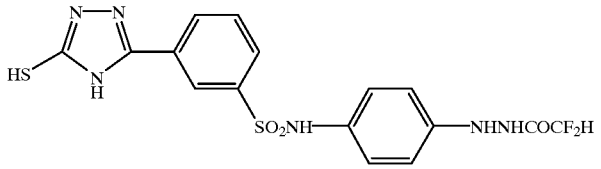
H-48
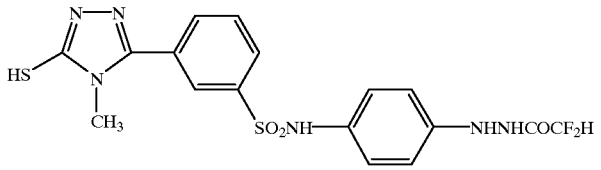

-continued
H-49
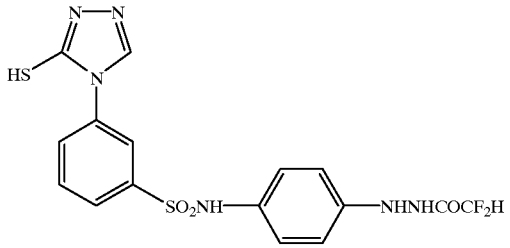
H-50
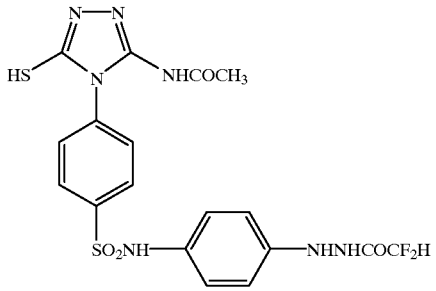
H-51
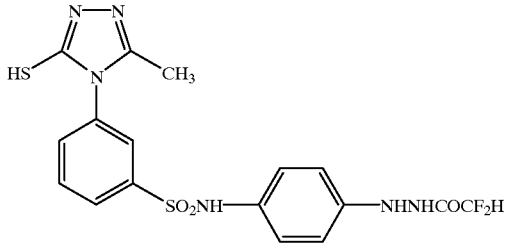
H-52
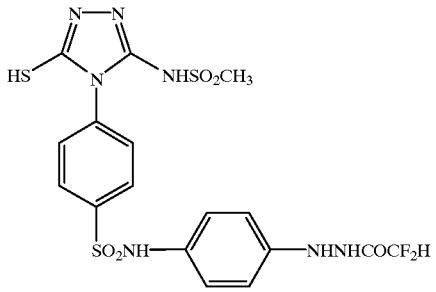
H-53
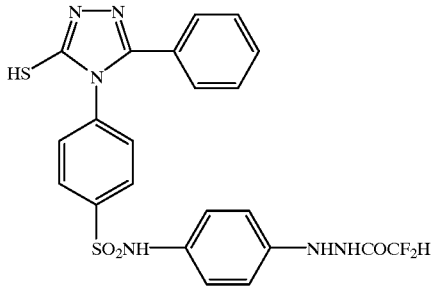

-continued
H-54
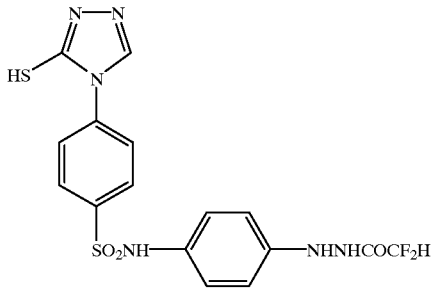
H-55
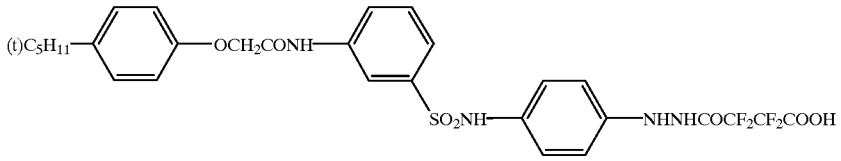
H-56
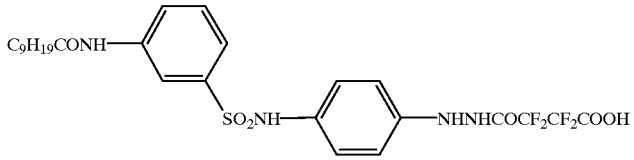
H-57
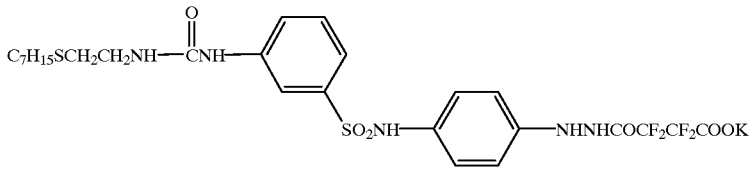
H-58
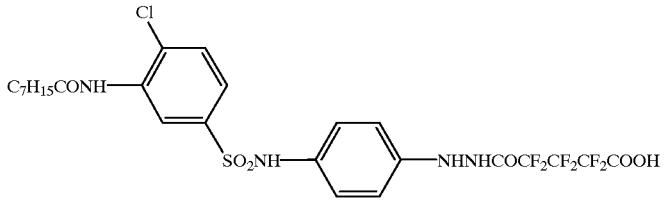
H-59
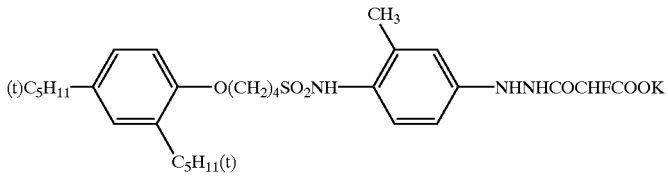
H-60
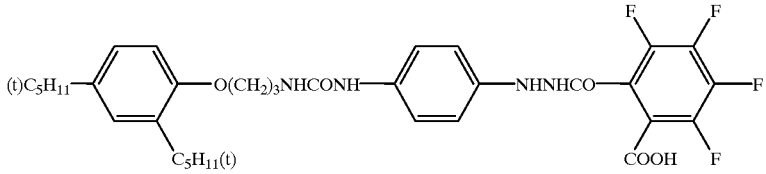

-continued

H-61

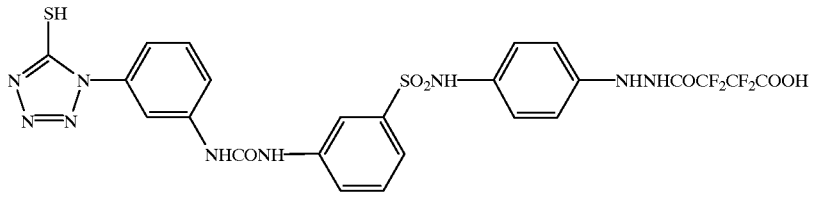

H-62

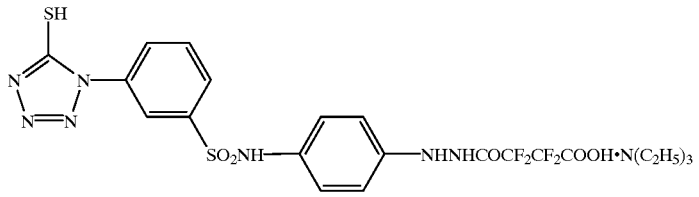

H-63

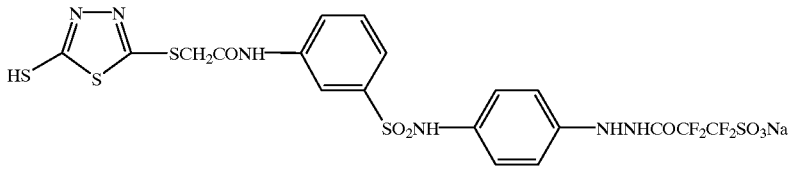

In addition, as examples of preferred hydrazine derivatives, for example, exemplified Compounds (1) through (252) disclosed on column 4 through 60 of U.S. Pat. No. 5,229,248 can be cited.

The hydrazine derivatives used in the present invention can be synthesized according to the conventionally known methods in the art. For example, they may be synthesized according to the method disclosed on column 59 through 80 in U.S. Pat. No. 5,229,248.

An added amount of the hydrazine derivative is, if said amount can make a high contrast image, any amount (high contrast making amount) may be employed, but usually within the range of $10^{-6}$ to $10^{-1}$ mole per mole of silver halide, preferably $10^{-5}$ to $10^{-2}$ mole, even though an optimal amount is varied depending on the diameter of silver halide grains, halide composition, and the degree of chemical sensitization of silver halide grains, and the kind of restraining agent.

The hydrazine compound can be added in at least a component layer on a silver halide emulsion layer side, and is preferably added in a silver halide emulsion layer and/or its adjacent layer, and is more preferably added in an emulsion layer. Further, an added amount of the hydrazine derivative contained in a photographic component layer closest to a support, of all the component layers containing the hydrazine derivative, is 0.2 to 0.8 mol equivalent to that contained in a photographic component layer farther from the support than the aforesaid photographic component layer being closest to the support, and is preferably 0.4 to 0.6 mole equivalent. The hydrazine derivative may be used singly or in combination of two or more kinds.

In case of applying the above-mentioned high contrast enhancing agent to the light-sensitive material processed, a nucleation accelerating agent is preferably used to promote the high contrast.

The nucleation accelerating agents preferably include, for example, compounds represented by the following formulas (Na) and (Nb).

Formula (Na)

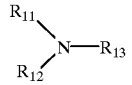

Formula (Nb)

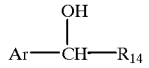

In the formula (Na), $R_{11}$, $R_{12}$ and $R_{13}$ represent a hydrogen atom, an alkyl group, a substituted alkyl group, an alkenyl group, a substituted alkenyl group, an alkynyl group, an aryl group and a substituted aryl group. $R_{11}$, $R_{12}$ and $R_{13}$ can form a ring with each other. Of these, the most preferable group is an aliphatic tertiary amine group. The above mentioned groups preferably contain a nondiffusible group or a silver halide adsorbing group. In order to make the above mentioned groups nondiffusible, a compound preferably has a molecular weight of not less than 100, and more preferably has a molecular weight of not less than 300. Further, examples of preferable silver halide adsorbing groups include a heterocyclic group, a mercapto group, a thioether group, a selenoether group, a thione group, a thiourea group, and the like. The most preferable group represented by the formula (Na) is a compound having a thioether group as a silver halide adsorbing group.

Exemplified nucleation accelerating agents will be illustrated below.
Na-1
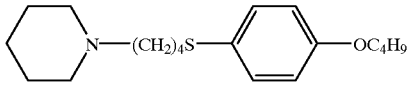
Na-2
$[(C_3H_7)_2N(CH_2)_3OCH_2CH_2]_2S$
Na-3
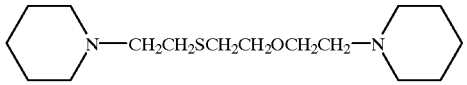
Na-4
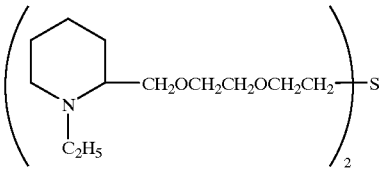
Na-5
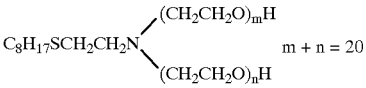
Na-6
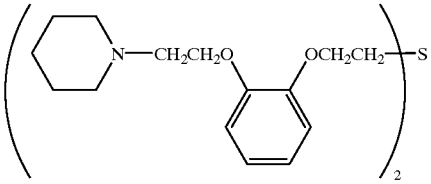
Na-7
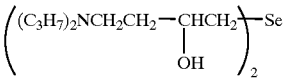
Na-8
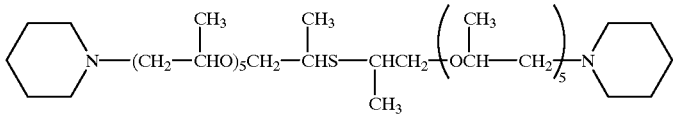
Na-9
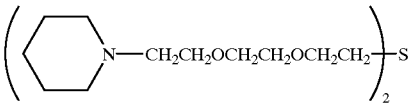
Na-10
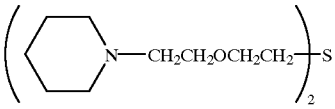
Na-11
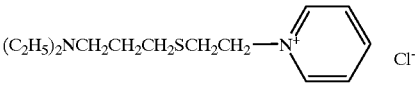
Na-12
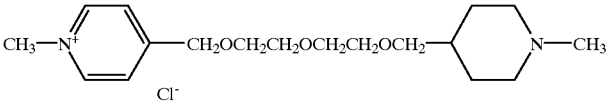

-continued

Na-13

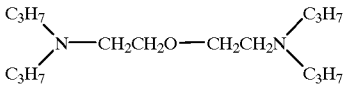

Na-14

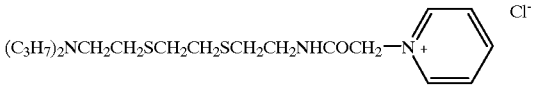

Na-15

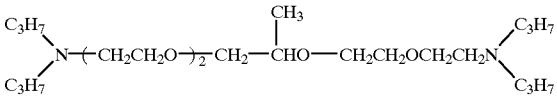

Na-16

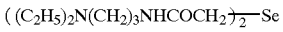

Na-17

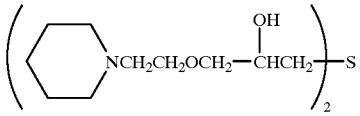

Na-18

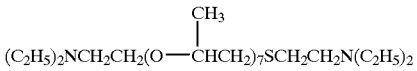

Na-19

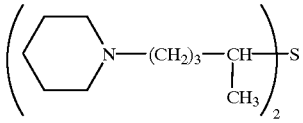

Na-20

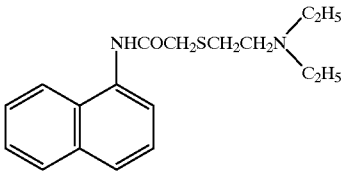

Na-21

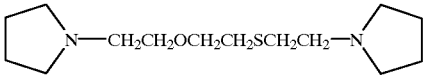

In the above mentioned formula (Nb), Ar represents a substituted or unsubstituted aromatic group or a heterocyclic group. $R_{14}$ represents a hydrogen atom, an alkyl group, an alkynyl group and an aryl group. Ar and $R_{14}$ may form a ring linked with a linking group with each other. Compounds represented by the formula (Nb) preferably have nondiffusible groups or silver halide adsorbing groups. In order to make these compounds nondiffusible, a molecular weight is preferably not less than 120, and is more preferably not less than 300. Further, preferable silver halide adsorbing groups are the same as those cited for the formula (H).

Exemplified compounds represented by the formula (Nb} will be illustrated below.

Nb-1

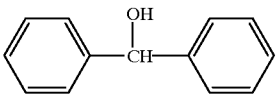

Nb-2

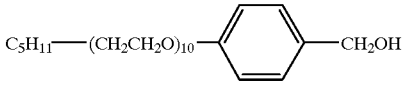

-continued

Nb-3

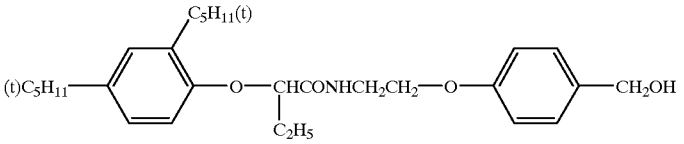

Nb-4

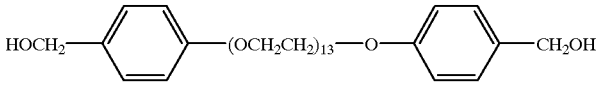

Nb-5

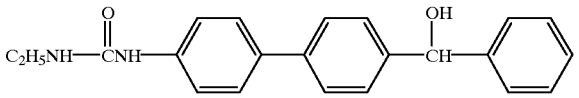

Nb-6

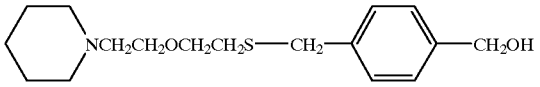

Nb-7

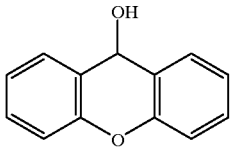

Nb-8

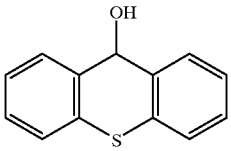

Nb-9

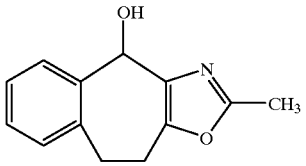

Nb-10

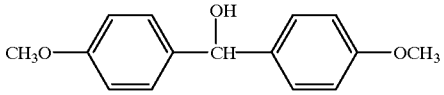

Nb-11

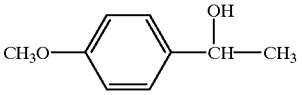

Nb-12

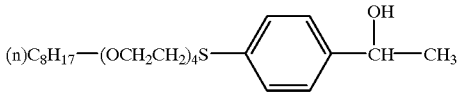

Other exemplified nucleation accelerating agents are exemplified compound (2-1) to (2-20) and (3-1) to (3-6) described in JP-A No. 6-258751, onium compounds described in 7-270957, compounds represented by the formula I described in 7-104420, thiosulfonic acids described on line 19 of under right column of page 17 to line 4 of upper right column of page 18 of JP-A No. 2-103536, and further thiosulfonic acids described in JP-A No. 1-237538.

The nucleation accelerating agent used in the present invention can be used in any photographic component layer, but it may be preferably incorporated in a silver halide emulsion layer or an adjacent layer to said silver halide emulsion layer. Further, an added amount is preferably within the range of $10^{-6}$ to $10^{-1}$ mole per mole of silver halide, preferably $10^{-5}$ to $10^{-2}$ mole, even though an optimal amount is varied depending on the diameter of silver halide grains, halide composition, and the degree of chemical sensitization of silver halide grains, and the kind of retraining agent.

The kinetic friction coefficient according to the present invention will now be detailed.

The kinetic friction coefficient ($\mu k$) according to the present invention can be obtained based on the theory of friction coefficient test method described in JIS K7125.

A silver halide photographic light-sensitive material is allowed to stand under conditions of 25° C., 60% RH for not less than 1 hour, after which, a constant weighted sapphire needle (diameter being from 0.5 to 5 mm, contacting force being from 50 to 200 g) is placed and slid on the surface of said silver halide photographic light-sensitive material at a constant sliding speed (sliding speed being from 20 to 100 cm/min.), at that time, the kinetic friction force (Fk) is measured, thus, the kinetic friction coefficient can be measured by the following formula (1), $$\mu k = Fk/Fp \quad \text{Formula} \qquad (1)$$

$\mu k$: kinetic friction coefficient

Fk: kinetic friction force (g)

Fp: contacting force (g)

Surface property measuring tester produced by Shinto Kagaku Co. Ltd. can be employed for measuring said kinetic friction coefficient.

In the present invention, the kinetic friction coefficient on the surface of an emulsion layer side is from 0.10 to 0.35, is preferably from 0.10 to 0.33, and is more preferably from 0.15 to 0.30.

A lubricant may preferably be employed to make the kinetic friction coefficient of the outermost layer not more than 0.35. The lubricant may preferably be employed in the outermost layer of the emulsion side.

Examples of representative lubricants used in the present invention include, for example, silicone type lubricants described in U.S. Pat. No. 3,042,522, British Patent No. 955,061, U.S. Pat. Nos. 3,080,317, 4,004,927, 4,047,958, 3,489,567, and British Patent No. 1,143,118, higher fatty acid type, alcohol type, acid amide type lubricants described in U.S. Pat. Nos. 2,244,043, 2,732,305, 2,976,148, 3,206,311, metal soaps described in British Patent No. 1,263,722, U.S. Pat. No. 3,933,516, ester type, ether type lubricants described in U.S. Pat. Nos. 2,588,765, 3,121,060, British Patent No. 1,198,387, and taurine type lubricants, colloidal silica type lubricants described in U.S. Pat. Nos. 3,502,473, 3,042,222, or the like.

As lubricants used in the present invention, an alkyl polysiloxane and liquid paraffin, which is liquid at room temperature, are preferably used. Furthermore, more preferable ones are an alkyl polysiloxane, having polyoxylalkylene at a side chain, described by the following formula (1), and an alkyl polysiloxane described by the following formula (2).

Formula (1)

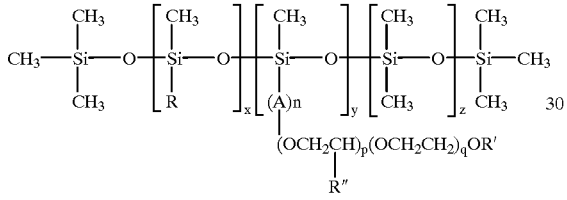

In the formula (1), R represents an aliphatic group, for example, an alkyl group (preferably an alkyl group having 1 to 18 carbon atoms), a substituted alkyl group (e.g., an aralkyl group, an alkoxyalkyl group, an aryloxyalkyl group, or the like), or an aryl group (e.g., a phenyl group, or the like). R' represents a hydrogen atom, an aliphatic group, for example, an alkyl group (preferably an alkyl group having 1 to 12 carbon atoms), a substituted alkyl group, or an aryl group (e.g., a phenyl group). R" represents an alkyl group (e.g., a methyl group, or the like), or an alkoxyalkyl group (e.g., a methoxymethyl group, or the like). A represents a divalent hydrocarbon group. n represents 0 or an integer of 1 to 12; p is an integer of 0 to 50; q is an integer of 2 to 50 (being preferably 2 to 30); x is an integer of 0 to 100; y is an integer of 1 to 50; z is an integer of 0 to 100; while the sum of x+y+z is an integer of 5 to 250 (preferably 10 to 50).

Examples of R include a methyl group, an ethyl group, a propyl group, a pentyl group, a cyclopentyl group, a cyclohexyl group, a dimethylpentyl group, a heptyl group, a methylhexyl group, an octyl group, a dodecyl group, an octadecyl group, a phenylethyl group, a methylphenylethyl group, a phenylpropyl group, a cyclohexylpropyl group, a benzyloxypropyl group, a phenoxypropyl group, an ethyloxypropyl group, a butyloxyethyl group, a phenyl group, or the like. Examples of a group represented by A include a methylene group, a 1-one-trimethylene group, a 2-methyl-1-one-trimethylene group, or the like. Examples of an alkyl group represented by R' include a methyl group, an ethyl group, a propyl group, a butyl group, an amyl group, a hexyl group, a heptyl group, an octyl group, a nonyl group, a decyl group, a dodecyl group, or the like.

Formula (2)

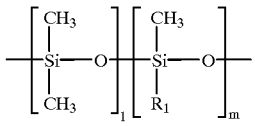

The formula (2) includes a straight chain siloxane having a siloxane unit represented by the following formula (2-1), or a straight chain siloxane having a terminal group represented by the following formula (2-2).

Formula (2-1)

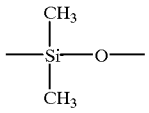

Formula (2-2)

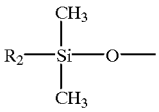

In the formula (2), $R_1$ represents an alkyl group, a cycloalkyl group, an alkoxyalkyl group, an aryloxy group, an aryloxyalkyl group, or a glycidyloxyalkyl group, and each of these groups has 5 to 20 carbon atoms. In the formula (2-2), $R_2$ represents an alkyl group having 1 to 20 carbon atoms, a cycloalkyl group having 5 to 20 carbon atoms, an alkoxyalkyl group, an arylalkyl, an aryloxyalkyl, or glycidyloxyalkyl group. 1 is 0 or an integer of not less than 1, and m is an integer of not less than 1, while the sum of 1+m is an integer of 1 to 1000, is preferably an integer 2 to 500. Examples of groups represented by $R_1$ of the formula (2) include a pentyl group, a methylpentyl group, a cyclopentyl group, a cyclohexyl group, a dimethyl pentyl group, a heptyl group, a methylhexyl group, an octyl group, an eicocyl group, a phenylethyl group, a methylphenylethyl group, a phenylpropyl group, a cyclohexylpropyl group, a benzyloxypropyl group, a phenoxypropyl group, a tolyloxypropyl group, a naphthylpropyl group, an ethyloxypropyl group, a butyloxyethyl group, an octadecyloxypropyl group, a glycidyloxypropyl, a glycidyloxybutyl group, or the like.

A poly siloxane, being a lubricant used in the present invention, represented by the following formula (3) will be detailed below.

Formula (3)

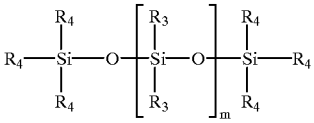

In the formula (3), $R_3$ represents an alkyl group having 1 to 3 carbon atoms, while $R_4$ represents an alkyl group having 1 to 3 carbon atoms or an alkoxy group having 1 or 2 carbon atoms. m is an integer of 0 to 2000. Representative compounds represented by the formulas (1), (2), and (3) are exemplified.

(1-1)
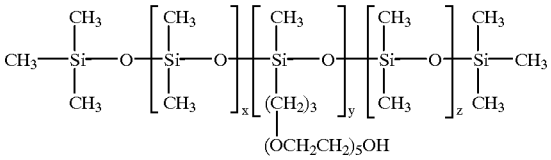
X + Y + Z = 30
(1-2)
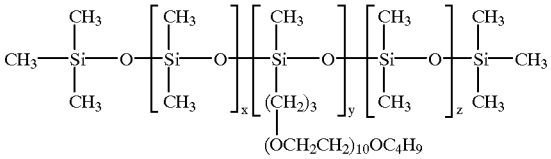
X + Y + Z = 40
(1-3)
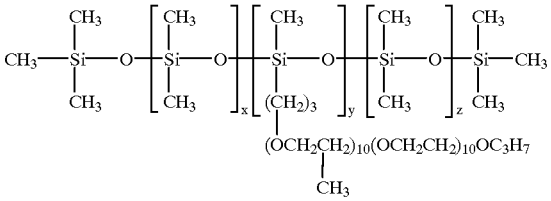
X + Y + Z = 35
(1-4)
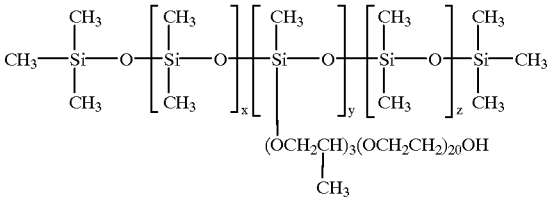
X + Y + Z = 50
(1-5)
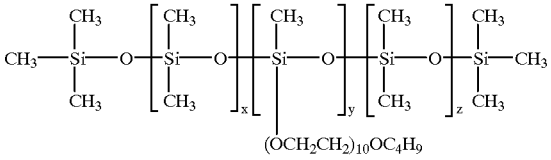
X + Y + Z = 100
(1-6)
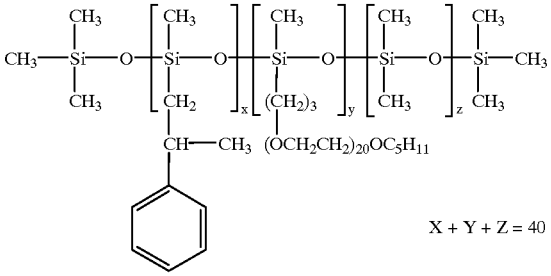
X + Y + Z = 40
(2-1)
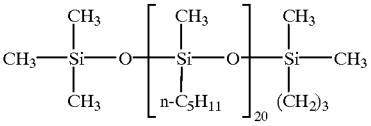
(2-2)
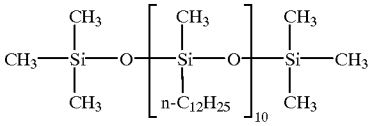
(2-3)
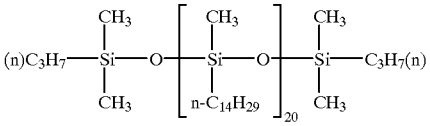

-continued (2-4)

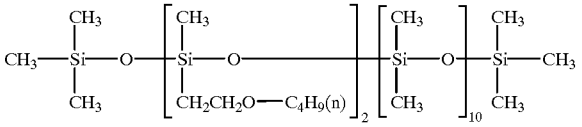

(2-5)

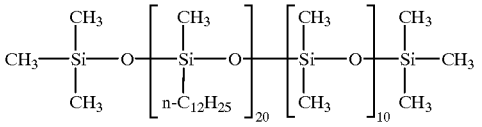

(2-6)

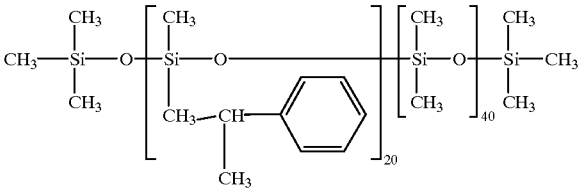

(2-7)

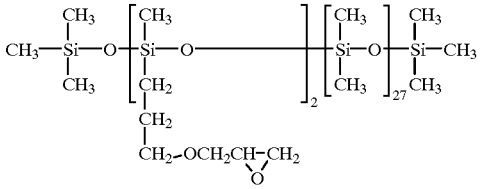

(3-1)

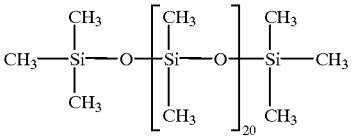

(3-2)

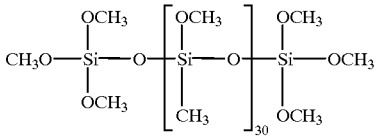

In the present invention, an anion surfactant represented by the following formula (4) is advantageously employed.

Formula (4)

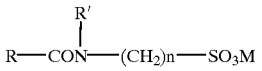

In the formula (4), R represents a substituted or unsubstituted alkyl group having 3 to 30 carbon atoms, an alkenyl group, or an aryl group, and R' represents a hydrogen atom, a substituted or unsubstituted alkyl group, an alkenyl group or an aryl group. n is an integer 2 to 6, and M represents a hydrogen atom, an inorganic or organic cation. Examples of an anionic surfactant represented by the formula (4) will be illustrated below.

(4-1)

$C_3H_7CONHCH_2CH_2SO_3Na$ (4-2)

$C_9H_{19}CONHCH_2CH_2SO_3Na$ (4-3)

$C_{17}H_{35}CONHCH_2CH_2SO_3Na$ (4-4)

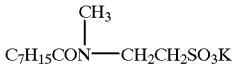

(4-5)

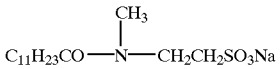

(4-6)

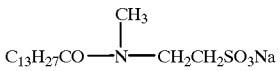

(4-7)

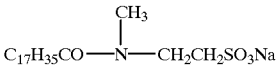

-continued (4-8)

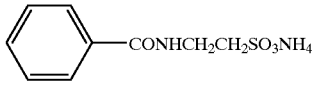

(4-9)

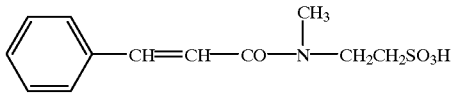

(4-10)

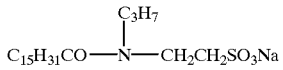

A coated amount of the above mentioned lubricant is 0.01 to 1.0 by weight to a coated amount of binder contained in an outermost layer, and is preferably 0.05 to 0.5. Further, 0.01 to 0.1 g/m$^2$ is specifically preferred.

A coated amount of the anionic surfactant represented by the formula (4) is 0.001 to 0.5 g/m$^2$, and is preferably 0.01 to 0.2 g/m$^2$.

In the present invention, to improve pressure resistance as well as preservation property without sensitivity loss, use of a polyhydroxybenzene compound is preferred.

Said polyhydroxybenzene compound is preferably included in any of the following structures.

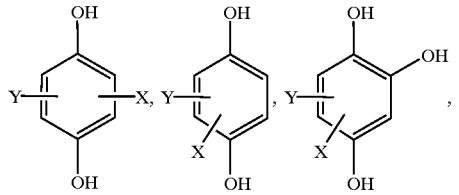

In the above-illustrated structures, X and Y each represent a hydrogen atom, a hydroxy group, a halogen atom, an —OM group (M being an alkali metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxypenyl group, a carboxyalkyl group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group. Of these, preferably cited are a hydrogen atom, a hydroxy group, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$, $—SCH_3$, or

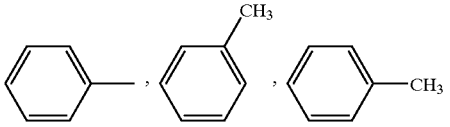

X and Y may be the same or different. Preferable exemplified compounds will be illustrated below.

D-(1)

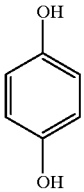

D-(2)

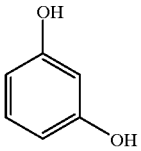

D-(3)

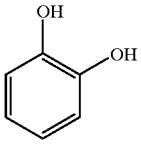

D-(4)

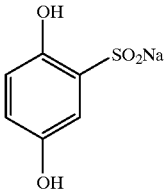

D-(5)

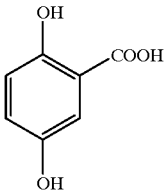

-continued

D-(6)

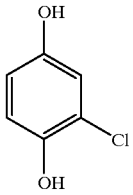

D-(7)

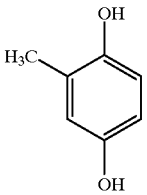

D-(8)

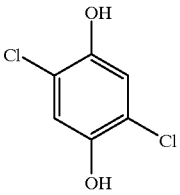

D-(9)

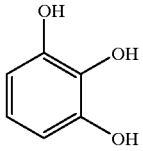

D-(10)

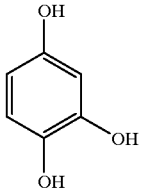

These polyhydroxy benzene compounds may be incorporated in an emulsion layer or any layer other than the emulsion layer. An effective added amount of these compounds is from $10^{-5}$ to 1 mol per mol of silver, and more effective amount is $10^{-3}$ to $10^{-1}$ mols.

The impedance of a film material of the present invention will be now detailed.

The impedance of the film material of the present invention can be measured employing an impedance measuring apparatus used for measuring a dielectric constant of electric parts. However, preferred is a measuring apparatus in which an impedance measuring apparatus capable of measuring an frequency of not less than 1 Hz and an electrode used for measuring film impedance are combined. For example, is cited a combined usage of Precision LCR meter HP4284A produced by Hewlett Packard Co. (hereinafter referred to as HP) with HP16451B. When other apparatus is employed, correction of an electrode is necessary.

For the accomplishment of the present invention, the impedance of the film material must be correctly measured. Therefore, when a measuring apparatus incapable of correction of impedance is used, desired results can not be obtained. A detailed example to obtain the impedance at 20 Hz employing the above-mentioned combined usage will be described below. However, if a correct absolute value of the impedance at 20 Hz can be obtained, a measuring method is not limited in the present invention.

Employing a Precision LCR meter HP4284A in which two electrodes composed of two parallel planes and HP16451B having a guard electrode are connected, an absolute value of the impedance of the film material is obtained under conditions of 23° C., 20% RH by a void method.

To employ said void method, an electrode non-contacting method is used based on explanatory note on HP16451B. With respect to size of a sample, there is no limitation, if said sample is larger than an electrode plane. When a diameter of a main electrode is 3.8 cm, a square sample of which size is from 5×5 cm to 6×6 cm is preferred. If specific resistances of both sides of a sample, obtained by continuous current, are equal, both sides can be placed upwardly, however, the specific resistances of both sides are different from each other, one side of said sample with lower specific resistance is placed upwardly, after which, said sample is inserted between two electrodes composed of two parallel planes and the specific resistance is measured by the void method while applying alternate current.

The absolute value of impedance measured at 20 Hz, by employing an electrode of which area is from 11 to 12 $cm^2$, is from $4\times10^{5}\Omega$ to $10^{20}$ Ω, and is preferably from $8\times10^{5}$ Ω to $10^{20}$ Ω, and is more preferably from $1\times10^{6}$ Ω to $10^{10}$ Ω.

In the present invention, a conducting layer is preferably applied onto a support.

An added amount of conductive particles contained in a conducting layer is, depending on the color, shape, composition, and kind of the particles, taking transparency and the above-mentioned desired impedance into account, not more than 50 vol % per unit volume, and is preferably not more than 40 vol %, and is more preferably not more than 37 vol %. If more severe transparency is required, an added amount of conductive particles contained in the conducting layer is not more than 28 vol %, and is more preferably not more than 20 vol %. The minimal amount of conducting particles is required from the viewpoint of previously mentioned desired impedance range. If taking the above-mentioned impedance range into account, an added amount of the conductive particles is not less than 1 vol %, and is preferably not less than 5 vol %, and is more preferably not less than 10%.

Further, other additives can be contained in the conducting layer, for example, an organic compounds, of which Tg or melting point is not higher than 50° C., may be contained in the conducting layer. More of these organic compounds may be preferably contained in the conducting layer in point of improving cracks and the like, but an extreme more of these organic compounds can not be contained in the conducting layer, because the impedance is lowered though it is not preferable. From these reasons, the added amount of these compounds is determined based on the absolute value of the impedance, however, preferable amount from 0.0001 vol % to 10 vol %, and is preferably 0.0001 vol % to 8 vol %, and is more preferably 0.0001 vol % to 5 vol %.

The conduction layer of the present invention is composed of conductive particles, a high molecular binder, and further an organic compound having Tg or melting point of not higher than 50° C. and the like, and thus, the absolute value of the impedance is regulated. If necessary, within the scope of the present invention, a cross-linking compound, a surfactant, a matting agent and the like may be incorporated in the conducting layer. However, since addition of these compounds leads to lowering of the absolute value of the impedance and the object of the present invention is not achieved, additional amount of these compounds over the scope of the present invention is not acceptable.

Added conductive particles may be composed of any of an organic material, an inorganic material, or a combined material of the aforesaid materials. Namely, a volume intrinsic resistance of a principal component of the conductive particles is from $10^{-5}$ Ωcm to $10^{9}$ Ωcm. Conductive particles may be composed of single material or combination of different materials. Preferable ones are white or colorless metal oxide type particles. With these particles, conductivity tends to be lowered. A material of $10^{-1}$ Ωcm to $10^{9}$ Ωcm is preferably selected.

For the use of a photographic light-sensitive material of which transparency is desired, an amorphous metal oxide sol is preferred, and material of 10 Ωcm to $10^{8}$ Ωcm is preferably selected. Particle size of these particles is not limited, but in images photographed with an electron microscope, particle size of small particles is preferably not more than 10 μm, and is more preferably not more than 1 μm. When transparency is strongly demanded, the particle size is preferably 0.5 μm, and is more preferably from 0.001 to 0.5 μm which only an amorphous metal oxide sol can give.

With respect to the volume intrinsic resistance, the value, which is obtained by dividing the volume intrinsic resistance of an objective form, made from powder to which is applied constant pressure, by $10^{2}$, is employed. The constant pressure is not limited, but it is preferably not less than 10 kg/$cm^2$, and is more preferably from 100 kg/$cm^2$ to 10 t/$cm^2$. The value, which is obtained by dividing the volume intrinsic resistance of the objective form, made by applying pressure of 100 kg/$cm^2$ to 10 t/$cm^2$, by $10^{2}$, is employed. Generally, with respect to the relationship between pressure applied to the powder and the volume intrinsic resistance of the objective form, as the pressure increases, the volume intrinsic resistance tends to decrease. However, in the case that isotropic pressure of 3 t/$cm^2$ is applied with a hydrostatic pressure apparatus, the volume intrinsic resistance lower than that of monocrystal is not obtained, and usually the volume intrinsic resistance about 100 times as high as that of the monocrystal is obtained.

Therefore, the value which is obtained by dividing the volume intrinsic resistance of the objective form, obtained from the powder to which is applied constant pressure, by $10^{2}$, is employed.

Further, in general, a semi-conductor has the volume intrinsic resistance of from 10 Ωcm to $10^{12}$ Ωcm, and a conductor has the volume intrinsic resistance of less than 10 Ωcm. In the present invention, the semi-conductor and conductor are termed conductor particles.

Either crystalline or amorphous structure of the conductor particles may be employed in the present invention. Further, higher structure, inclined composition, regular composition distribution, or irregular composition distribution may be employed, if the composition and object of the present invention are attained.

Examples of the organic material include conjugated higher molecules such as tetracyanoquinodimethane (TCNQ), tetrathiofulvalene, polyacetylene (TTF), coterilene, poly-para-phenylene, polythiophene, polypyrrole, polyaniline, etc.; other higher molecules which are obtained from the aforesaid higher molecules doped with appropriate doping agents; compounds consisting of ionic conductive higher molecules such as polyvinyl-benzenesulfonic acid salts, polyvinyl-benzyl-trimethyl ammonium chloride, quaternary salt polymer, etc.

Still further, fine particles obtained by dispersing a carbon material in an organic resin and hardening them can also be used. As regards carbonic materials, they are materials manufactured through carbonizing process from organic compounds as starting materials, and, for example, coke, carbon fibers, vitreous carbon, thermally decomposed carbon, whisker, carbon black, etc, can be mentioned.

Particles which are in the boundary domain between organic and inorganic can also be applicable if they are electrically conductive and, for example, compounds having electro-conductivity not greater than $10^9$ Ωcm disclosed in Japanese Patent O.P.I. No. 6-248092 are suitable.

As examples of inorganic material, chalcogenide glass having metallic or electro-conductive property, particles of metal oxides, etc. can be mentioned. In light of chemical stability, metal oxides are preferable. However, of course, there is no specific limitation as to the material as far as it has an electro-conductive property. When a metal oxide is employed, any conventional method of synthesis can be used if it can attain the objective of the present invention. For example, manufacturing methods of fine and ultra-fine particles including, a co-precipitation method, a multi-step wet process, a sol-gel method, an atomizing method, a plasma thermal decomposition process, etc. can be mentioned.

Herein, for the metal or compounds containing a metal includes, depending upon synthesizing method, compounds containing Li, Na, K, Rb, Cs, Be, Mg, Ca, Sr, Ba, Sc, Y, La, Ce, Ti, Zr, V, Nb, Cr, Mo, W, Mn, Fe, Co, Ni, Ru, Rh, Pd, Os, Ir, Pt, Cu, Ag, Au, Zn, Al, Ga, In, Tl, Si, Ge, Sn, Pb, As, Sb, Bi, Se, Te, and Po can be mentioned. More preferably, they are compounds containing, as their main ingredient, Ni, Ir, Rh, Nb, Ce, Zr, Th, Hf, Zn, Ti, Sn, Al, In, Si, Mg, Ba, Mo, W and V. Preferably, compounds which are soluble in water or organic solvents and, for example, water-soluble metal salts such as $FeSO_4.7H_2O$, $CuSO_4$, etc.; metal compounds which are soluble in organic solvents including, for example, $NiCl_2$, $PdCl_2$, etc; metal alkoxide such as $Ti(OC_3H_7)_4$, etc.; or organic metal oxide compounds such as ferrocene, etc. may be selected. Depending upon the method of synthesis, metals or metal compounds containing a metal as their main ingredient materials, which are solid under the room temperature, can be used in combination. There is no specific limitation as to raw materials and manufacturing methods and any material or manufacturing method can be employed.

With reference to composition of crystal figure of the metal oxide particles obtained according to these manufacturing methods mentioned above, any composition or any crystal figure may be employed as far as they can attain the objectives of the present invention.

For example, compounds taking specific lattices such as simple cubic lattice, body-centered cubic lattice, face-centered cubic lattice, simple rhombic lattice, bottom face-centered rhombic lattice, body-centered rhombic lattice, face-centered rhombic lattice, simple monoclinic lattice, bottom face-centered monoclinic lattice, triclinic lattice, rhombohedral lattice, hexagonal lattice etc. can be mentioned.

Moreover, in the present invention, crystalline porous material may also be used.

Besides these specific compounds, particles, from which any sharp diffraction peaks can be obtained when they are evaluated by powder x-ray diffraction method may also be used. If the composition of itself takes a specific crystal habit, or if most values of diffraction peaks can be identified with certain specific crystal, however, even if the peaks are not obvious due to partial widening of diffraction peaks, or even in the case of amorphous powder, of which all peaks have been widened, it can still be used if the objective of the present invention can be achieved. For an example of this kind of metal oxide, colloidal $SnO_2$ sol can be mentioned. This compound does not cause a problem such as precipitation and is a preferable compound to achieve the objective of the present invention. As regards manufacturing method of $SnO_2$ ultra-fine particles, temperature condition is particularly important and a method accompanying a thermal treatment at high temperature is not preferable because it brings about growth of primary particles or high degree of crystallization. When heat treatment is unavoidable, it should be carried out at not higher than 400° C., preferably, not higher than 300° C., more preferably not higher than 200° C. and, still more preferably, not higher than 150° C. The $SnO_2$ sol, of which manufacturing method is disclosed in Japanese Patent Publication No. 35-6616 is a suitable example for the present invention. Still further, materials doped with a different kind of elements such as fluorine or antimony, etc. are also suitable.

As regards organic compounds, of which Tg or fusing point is not higher than 50° C., there is no specific limitation as to materials selected from categories selected from monomer, oligomer and polymer, however, preferably, polyether-type compounds such as ethylene glycol, propyrene glycol, 1,1,1-trimethylol propane, polyethylene glycol, polypropylene glycol, etc.; acryl-type compound such as polybutyl acrylate, polyacrylamide, etc.: polyvinyl alcohol, polyester-type compounds, etc. are preferable. There is no specific limitation as to manner of addition. For example, they may be added at the time of admixing the ingredients described in this invention, or when they are dispersed in water or an organic solvent, a solvent, to which other ingredients of the present invention are dispersed in advance in a dispersion medium such as water or an organic solvent, may be added.

Although there is no specific limitation as to binder as far as it is capable of film forming, for example, proteins such as gelatin, casein; cellulose compounds such as carboxymethyl cellulose, hydroxyethyl cellulose, acetyl cellulose, diacetyl cellulose, triacetyl cellulose, etc.; sugars such as dextran, agar, sodium arginate, starch derivative, etc.; synthetic polymers such as polyvinyl alcohol, poly vinyl acetate, polyacrylates, polymethacrylates, polystyrene, polyacrylamide, poly-N-vinyl-pyrrolidone, polyester, polyvinyl chloride, polyacrylic acid, etc. can be mentioned. Particularly, they are gelatin (lime-treated gelatin, acid-treated gelatin, enzyme-decomposed gelatin, phthalic gelatin, acetylated gelatin, etc.), acetyl cellulose, diacetyl cellulose, triacetyl cellulose, polyvinyl acetate, polyvinyl alcohol, poly butyl acrylate, polyacrylamide, dextran, water-soluble polyester resin, etc.

These electro-conductive particles and semi-conductive fine particles are used after dispersed or dissolved in a binder. Also, after admixing the electro-conductive powder or metal oxide particles in a solvent in which electro-conductive polymer material is dissolved or dispersed, coating may be performed by dispersing the powder, which was subjected to spray-drying or freeze-drying process, in a binder and, then coating can be performed.

As regards the method of dispersing the electro-conductive or semi-conductive particles in the (mixture of the polymeric binder and the organic compound having Tg or fusing point not higher than 50° C., a method using free rotary movement, a variety of methods including, for example, a method of using impeding movement in a container in which hindrance plates are provided, a method of using toppling movement caused when a sealed container is rotated around the horizontal axis, a method of utilizing oscillation movement by which the container is shaken up and down, a method of utilizing a shearing force on the roll, etc, any method can be selected as far as they may not jeopardize the objective of the present invention.

The invention is applied to a method to transfer the photosensitive material while scanning exposure by laser light. The exposing method is called capstan method or plane-scanning method, in which an image setter is employed as the exposing apparatus such as FT-R3035, FT-R3050, FT-R5055, FT-R5040 etc. manufactured by Dainippon Screen Mfg. Co., Ltd.

Various conventional laser light sources can be employed in the image forming method according to the invention. Particularly preferred is a laser light source such as He—Ne laser, LED, infrared semiconductor laser, red light semiconductor laser, Ar laser and so on.

In case the exposing time by the laser light is extremely short such as not more than $10^{-7}$ sec. the advantage of the invention is remarkable.

Transferring speed of the photosensitive material during exposure is preferably 15 to 100 mm/sec., and the advantage of the invention is remarkable at 22 to 100 mm/sec. Particularly the advantage of the invention is remarkable at 25 to 100 mm/sec. Particularly it is preferred that the photographic material is transferred at the exposing time by the roller. The rollers may be arranged in such way that pair of the rollers are opposed so as to pinch the photographic material as transferring, or arranged in zigzag. Various roller such as metal roller, resin roller and gum roller may be employed as the roller. The preferable examples are resin roller and gum roller. The roller is more preferably gum roller to display the advantage of the invention. Gum roller is superior in film conveying without damaging the film. Silicone, EBPM, chloroprene, neoprene etc. is preferably employed as the material of the gum roller. Phenol, PPS, PPO, PPE, Teflon, fluoride, vinyl chloride, polystyrene etc. is preferably employed as the material of the resin roller. The photographic material is preferably transferred straight but not along with a curve during the exposure. The photographic material is preferably exposed by an image setter which is an exposing apparatus with an automatic developer in combination integrally to display the advantage of the invention.

Composition of halide in the silver halide of the photosensitive material is not specifically restricted. In case of processing with low amount replenishing or rapid processing, it is preferred to employ silver halide emulsion composed of silver chlorobromide containing not less than 60 mol % silver chloride or silver chloroiodobromide containing not less than 60 mol % silver chloride.

Preferable average grain size of the silver halide is not more than 1.2 $\mu$m, particularly preferably 0.8 to 0.1 $\mu$m.

The average grain size is usually employed by specialist in the photographic science and is readily understood. The term "grain size" usually refers to as diameter of the grain, when the grain is of spherical shape or in the form close thereto. In the case when the grain is a cubic shape, it means as average diameter of a sphere when the cube is converted into a sphere having the equivalent volume. With regard to the method of obtaining the average diameter, one can refer to the disclosure on pages 36–43, third edition of "The theory of the photographic process" edited by C. E. Mees and T. H. James and published by Mcmillan Co. in 1966.

There is no limitation as to the shape of the silver halide grain, and any one of tabular, cubic, spherical, tetradecahedral or octahedral shape can optionally be used. Concerning grain size distribution, the narrower, the more preferable. Particularly, so-called mono-dispersed emulsion, in which more than 90% (preferably 95%) of the total number of grains fall in the range ±40% around the average grain size, is preferable.

A method for mixing soluble silver halide and soluble halogen salt in the invention may include any of a single-sided mixing method, a simultaneous mixing method a combination thereof. It is also possible to use a method (so-called reverse precipitation method) in which grains are formed under the condition of excessive silver ions. As a type of double-jet methods, it is possible to use a method to keep the pAg constant in a liquid phase in which silver halides are produced, namely the so-called controlled double jet method. Owing to this method, it is possible to obtain a silver halide emulsion in which crystal shapes are regular and grain diameters are almost uniform.

The silver halide emulsion contains tabular grains, and preferably the tabular grains having an aspect ratio of 2 or more account for 50% or more of the projected area of the total grains contained in the silver halide emulsion layer. The tabular grains account for preferably 60 to 70%, more preferably 80% or more of the total grain projected area. The term, "aspect ratio" is referred to as a ratio of a diameter of a circle having the area equivalent to the grain projected area to spacing between two parallel major faces.

An emulsion composed of a tabular silver halide grain with ratio of not less than about 5 of a diameter to a thickness is preferred and an emulsion composed of a tabular grain with not less than 90% of silver chloride having (100) face as the major face is preferred. Such the emulsion is described in U.S. Pat. Nos. 5,264,337, 5,314,798, 5,320,958 etc., and can be prepared easily by referring to these.

On a specific site of the tabular grains, different silver halide can be epitaxially grown up or shelled. The tabular grains may have dislocation lines on the surface or in the interior of the grain to control sensitivity speck. Allowing fine silver iodide grains to be present or adding a soluble iodide during the course of chemical sensitization can form the dislocation line. With respect to preparation of the grains, acidic precipitation, neutral precipitation and ammoniacal precipitation may be optionally selected. In cases where metal is doped within the grain, it is preferred to form grains under the acidic condition of a pH of 1 to 5. To control grain growth during the course of grain formation is used a silver halide solvent, such as ammonia, thioethers, thiourea compounds, and thione compounds. The thioethers include 3,6,9,15,21-hexaoxa-12-thiatricosane; 3,9,15-trioxa-6,12-dithiaheptadecane;1,17-dioxy-3,9,15-tioxa-6,12-dithiaheptadecane-4,14-dione;1,20-dioxy-3,9,12,18-teraoxa-6,15-dithiaeicisane-4,17-dione; and 7,10-dioxa-4,13-dithiahexadecane-2,15,-dicarboxamide, as described in German Patent 1,147,845. Oxathioethers described in JP-A56-94347 and 1-121847 and cyclic oxathioethers described in JP-A 63-259653 and 63-301939 are also cited. Thioureas described in JP-A 53-82408 are usable. As exemplary examples thereof are cited tetramethylthiourea, tetraethylthiourea, dimethylpiperidinothiourea, dimorphorinothiourea; 1,3-dimethylimidazole-2-thione; 1,3-dimethylimidazole-4-phenyl-2-thione; and tetrapropylthiourea.

At the time of physical ripening or chemical ripening, metal salts of zinc, lead, thallium, iridium, rhodium, ruthenium, osmium, palladium, platinum, etc. can be coexisted. It is often commonly used to incorporate $10^{-8}$ to $10^{-3}$ of iridium per mol silver halide for the purpose of improving high intensity reciprocity law failure characteristics. In the present invention, in order to obtain an emulsion with high contrast, it is preferable for $10^{-9}$ to $10^{-3}$ mol of rhodium, ruthenium, osmium and/or rhenium per mol of silver halide to be incorporated in the silver halide emulsion.

A metal compound may be added in the form of a complex salt, in which the metal is coordinate with a halogen, carbonyl, nitrocyl, thionitrocyl, amine, cyan, thiocyan, ammonia, tellurocyl, selenocyan, dipyridyl, tripyridyl, phenanthroline or a combination thereof.

The Oxidation State of the metal may be optionally selected within the range of the minimum level to the maximum level. As preferred ligands are cited hexadentated ligands described in JP-A Nos. 2-2082, 2-20853, 2-20854 and 2-20855; alkali metal salts include a sodium salt, potassium salt and cesium salt and primary secondary and tertiary amines are also cited. A transition metal complex salt may be formed in the form of an aquo-complex. Examples thereof include $K_2[RuCl_6]$, $(NH_4)_2[RuCl_6]$, $K_2[Ru(NOCl_4(SCN)]$, and $K_2[RuCl_5(H_2O)]$. Ru may be replaced by Rh, Os, Re, Ir, Pd or Pt.

It is preferable that rhodium, ruthenium, osmium and/or rhenium compound is added during the time of forming silver halide grains. Addition thereof may be optional, including a method of distributing uniformly inside the grain and a method of localizing in the core or shell portion of core/shell-structure grains.

Sometimes, better results are obtained in the case when they are made present in the shell portion. Further, in the case when they are made present in a discrete layer structure, a method in which amount of presence is made greater depending on the distance from the center of the grain, may also be applied. Amount of addition may optionally be selected from the range between $10^{-9}$ and $10^{-3}$ mol per mol of silver halide.

Silver halide emulsions and preparation methods thereof are referred to Research Disclosure 17643 pages 22–23 (December 1973) and the references referred therein.

The silver halide emulsion used in the present invention may or may not be chemically sensitized. As method of chemical sensitization, sulfur sensitization, selenium sensitization, tellurium sensitization, reduction sensitization and noble metal sensitization have been well known in the art, and these methods may be used either singly or in combination. As a sulfur sensitizer, conventionally known sulfur sensitizers may be used. Preferable sulfur sensitizers include, besides sulfur compounds contained in gelatin, various sulfur compounds, for example, thiosulfates, thioureas, rhodanines, polysulfide compounds, etc. can be used. As selenium sensitizers, known selenium sensitizers may be used. For example, those compounds disclosed in U.S. Pat. No. 1,623,499, JP-A Nos. 50-71325 and 60-150046 may preferably be used.

Various compounds may be added for the purpose of preventing fog during manufacturing process, storage or development process or stabilizing photographic characteristics the photosensitive material of the invention. The following compounds known as an ant-foggant or stabilizer can be added. Examples are azoles such as benzothiazolium salts, nitro indazoles, nitrobenzimidazoles, chlorobenzimidazoles, bromobenzimidazoles, mercaptothiazoles, mercaptobenzthiazoles, mercapto benzimidazole class, mercaptothiadiazoles, aminotriazoles, benztriazoles, nitrobenzotriazoles, mercaptotetrazoles, particularly (1-phenyl-5-mercapto tetrazole; mercaptopyrimidines, mercaptotriazines; azaindenes such as triazaindenes, tetrazaindenes in particular 4-hydroxy-substituted-1,3,3a,7-tetrazaindenes, pentazaindenes; benzenthiosulfonic acids, benzenesulfinic acids and benzenesulfonic acid amides.

Gelatin is employed advantageously as a binder or protect colloid of the photographic emulsion, and other hydrophilic colloid may be employed. The hydrophilic colloids include, for example, gelatin derivatives, graft polymers comprised of gelatin and other polymers; proteins such as casein, albumin, etc.; cellulose derivatives such as hydroxyethyl cellulose, carboxymethyl cellulose, cellulose sulfates, etc.; sugar derivatives such as sodium alginate, starch derivatives, etc.; various synthetic hydrophilic homopolymers or copolymers such as polyvinyl alcohol and partial acetal thereof, poly-N-pyrrolidone, polyacrylic acid, polymethacrylic acid, polyacrylamide, polyvinyl imidazole, polyvinyl pyrazole, etc.

Gelatin includes an acid treated gelatin, and hydrolysis product of gelatin or enzyme decomposition gelatin may be employed other than lime gelatin.

It is preferable to add polysaccharide such as dextran, or dextrin compounds described in JP-A No. 9-304855 for an improvement of rapid processing.

In the photographic emulsion according to the present invention, for the purpose of improving dimensional stability, etc., synthetic polymers which are water-insoluble, or sparingly water-soluble can be incorporated. For example, alkyl(metha)acrylates, alkoxy(metha)acrylates, glycidyl(metha)acrylates, (metha)acrylamides, vinyl esters such as vinyl acetate, acrylonitrile, styrene, etc. may be used either singly or in combination. Further, these polymers may be used in the form of a copolymer together with other monomer constituents such as acrylic acid, methacrylic acid, α,β-unsaturated dicarboxylic acid, hydroxylalkyl(metha) acrylate, sulfoalkyl(metha)acrylate, styrene sulfonic acid, etc.

A silver halide emulsion layer or light-insensitive hydrophilic colloidal layer used in the invention may contains an organic or inorganic hardener as crosslinking agent of hydrophilic polymer such as gelatin. The compounds include chromium salts (chrome alum, chrome acetate etc.), aldehydes (formaldehyde, glutar aldehyde, glyoxal etc.), N-methylol compounds (dimethylol urea, dimethylol dimethylhydantoin etc.), dioxane derives (2,3-dihydroxydioxane), active vinyl compounds (1,3,5-triacryloyl-hexahydro-s-triazine, bis(vinylsulfonyl)methyl ether, N,N-methylenebis-[β-(vinylsulfonyl)propioneamide], etc.), active halogen compounds (2,4-dichloro-6-hydroxy-s-triazine, etc.), mucohalogenic acids (mucochloric acid, phenoxymucochloric acid, etc.) isooxazoles, dialdehyde starch, 2-chloro-6-hydroxytriazinyl gelatin, and carboxyl group-activating type hardeners, singly or in combination thereof. These hardeners are described in Research Disclosure Vol. 176, item 17643 (December., 1978), page 26, section A to C.

Various other additives may be employed in the photosensitive material, which includes desensitizing agent, plasticizer, lubricant, development accelerator, oil etc.

A support used in the present invention may be a transparent or nontransparent one, and a transparent plastic resin support is preferred for the purpose of the invention. As the plastic resin support may be employed a support comprising a polyethylene compound (e.g., polyethylene terephthalate, polyethylene naphthalate), a triacetate compound (e.g., triacetate cellulose), or polystyrene compound.

The thickness of the support is preferably 50 to 250 μm and more preferably 70 to 200 μm.

To make improvements in roll set curl, it is preferred to subject to heat treatment after casting of base. The treatment is most preferably after casting of base and before emulsion coating, but it may be made after emulsion coating. The condition for the heat treatment at a temperature of not lower than 45° C. and not higher than a glass transition temperature and over a period of one second to ten days is preferred. From the point of productivity is preferred a period within one hour.

Further it is preferable to incorporate the compounds described below in a constituting layer of the silver halide photographic light sensitive material.

1) Dye particles dispersed in a solid form

JP-A No. 7-5629, pp. 3, (0017) to pp. 16, (0042).

2) Acid group containing compounds

JP-A No. 62-237445, pp. 292 (2), lower left column, line 11 to pp. 309 (25), lower right column, line 3.

3) Acid polymer

JP-A No. 6-186659, pp. 10, (0036) to pp. 17, (0062).

4) Sensitizing dyes

JP-A No. 5-224330, pp. 3, (0017) to pp. 13, (0040).

JP-A No. 6-194771, pp. 11, (0042) to pp. 22, (0094).

JP-A No. 6-337492, pp. 3, (0012) to pp. 34, (0056).

JP-A No. 6-242533, pp. 2, (0015) to pp. 8, (0034).

JP-A No. 6-337494, pp. 4, (0013) to pp. 14, (0039).

5) Super sensitizing dyes

JP-A No. 6-347938, pp. 3, (0011) to pp. 16, (0066).

6) Hydrazine derivatives

JP-A No. 7-114126, pp. 23, (0111) to pp. 32, (0157).

7) Nucleation accelerating agent

JP-A No. 7-114126, pp. 32, (0158) to pp. 36, (0169).

8) Tetrazolium compounds

JP-A No. 6-208188, pp. 8,(0059) to pp. 10, (0067).

9) Pyridinium compounds

JP-A No. 7-110556, pp. 5, (0028) to pp. 29, (0068).

10) Redox compounds

JP-A No. 4-245243, pp. 235 (7) to pp. 250 (22).

11) Syndiotactic polystyrene support

JP-A No. 3-131843, pp. 324 (2) to pp. 327 (5).

The additives mentioned above and other known additives include those disclosed, for example, in Research Disclosure No. 17643 (December, 1978), Research Disclosure No. 18716 (November, 1979) and Research Disclosure No. 308119 (December, 1989).

It is preferable to process employing an automatic processor comprising four process as developing, fixing, rinsing (or stabilizing) and Known developing agent is employed in the present. Examples of the developing agent usable in the invention include dihydroxybenzenes (e.g., hydroquinone, hydroquinonemonosulfonate), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone), aminophenols (e.g., o-aminophenol, p-aminophenol, N-methyl-o-aminophenol, N-methyl-p-aminophenol, 2,4-diaminophenol), ascorbic acids (e.g., ascorbic acid, sodium ascorbate, potassium ascorbate, erythorbic acids), metal complex salts (e.g., Fe-EDTA, Fe-DTPA, Ni-DTPA). These are used in singly or in combination.

In particular, the present invention is characterized by image forming method by employing developer containing a developing agent represented by the following formula A.

Formula (A)

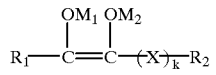

In Formula (A), $R_1$ and $R_2$ each independently represents a substituted or an unsubstituted alkyl group, a substituted or an unsubstituted amino group, a substituted or an unsubstituted alkoxy group, and a substituted or an unsubstituted alkylthio group, and $R_1$ and $R_2$ may be linked with together to form ring, k is 0 or 1, and X is —CO— or —CS— when k is 1, and $M_1$ and $M_2$ are each a hydrogen atom or an alkali metal atom.

Among the compound represented by the formula (A), the following compound represented by the formula (A-a) in which $R_1$ and $R_2$ are linked with together to form ring is especially preferable.

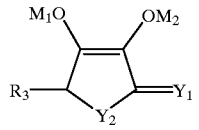

In Formula (A-a), $R_3$ represents a hydrogen atom, a substituted or an unsubstituted alkyl group, a substituted or an unsubstituted aryl group, a substituted or an unsubstituted amino group, a substituted or an unsubstituted alkoxy group, a sulfo group, a carboxyl group, an amide group and a sulfonamide group, $Y_1$ represents O, S or $NR_4$, $R_4$ represents a substituted or an unsubstituted alkyl group, and a substituted or an unsubstituted aryl group, and $M_1$ and $M_2$ are each a hydrogen atom or an alkali metal atom.

As an alkyl group in Formula (A) or Formula (A-a), is preferably cited a lower alkyl group having 1 to 5 carbon atoms, as an amino group is preferably cited an unsubstituted amino group or an amino group substituted by a lower alkyl group, as an alkoxy group is preferably cited a lower alkoxy group, as an aryl group is preferably cited a phenyl group or a naphthyl group which may possess substituents such as a hydroxyl group, a halogen atom, an alkoxy group, a sulfo group, a carboxyl group, an amide group and a sulfonamide group.

Examples of the compound represented by Formula (A) or Formula (A-a) are shown below, but are not limited thereto.

Formula (A)

| Compound No. | X | $R_1$ | $R_2$ | $M_1$ | $M_2$ |
|---|---|---|---|---|---|
| A-1 | — (k = 0) | $HOCH_2—CH(OH)—CH(OH)—$ | —OH | H | H |
| A-2 | — (k = 0) | $CH_3—CH(OH)—CH(OH)—$ | —OH | H | H |
| A-3 | — (k = 0) | $HOCH_2—CH(OH)—CH(OH)—$ | $—CH_3$ | H | H |
| A-4 | — (k = 0) | $CH_3—CH(OH)—CH(OH)—$ | $—CH_3$ | H | H |
| A-5 | —C(=O)— (k = 1) | $HOCH_2—CH(OH)—CH(OH)—$ | —OH | H | H |
| A-6 | —C(=O)— (k = 1) | $CH_3—CH(OH)—CH(OH)—$ | —OH | H | H |
| A-7 | —C(=S)— (k = 1) | $HOCH_2—CH(OH)—CH(OH)—$ | —OH | H | H |
| A-8 | —C(=S)— (k = 1) | $CH_3—CH(OH)—CH(OH)—$ | —OH | H | H |
| A-9 | —C(=O)— (k = 1) | $HO—CH_2—$ | —OH | Na | H |
| A-10 | —C(=O)— (k = 1) | $HO—CH_2—$ | $—CH_3$ | H | H |
| A-11 | —C(=O)— (k = 1) | $HO—CH_2—$ | $—C_2H_5$ | H | H |
| A-12 | —C(=O)— (k = 1) | $HO—CH_2—$ | $—C_2H_4OH$ | H | Na |

Formula (A-a)

| Compound No. | $Y_1$ | $Y_2$ | $R_3$ | $M_1$ | $M_2$ |
|---|---|---|---|---|---|
| A-13 | O | O | H | H | H |
| A-14 | O | O | $CH_3$ | H | H |
| A-15 | O | O | $CH_2(OH)$ | H | H |
| A-16 | O | O | $CH_3—CH(OH)—$ | H | H |

-continued

Formula (A-a)

| Compound No. | $Y_1$ | $Y_2$ | $R_3$ | $M_1$ | $M_2$ |
|---|---|---|---|---|---|
| A-17 | O | O | $HOCH_2—CH(OH)—$ | H | H |
| A-18 | O | O | $HOCH_2—CH(OH)—$ | Na | H |

-continued

Formula (A-a)

| Compound No. | $Y_1$ | $Y_2$ | $R_3$ | $M_1$ | $M_2$ |
|---|---|---|---|---|---|
| A-19 | O | O | $HOOCCH_2-CH(OH)-$ | H | Na |
| A-20 | S | O | H | Na | H |
| A-21 | S | O | $CH_3-CH(OH)-$ | H | H |
| A-22 | S | O | $HOCH_2-CH(OH)-$ | H | H |
| A-23 | O | $NCH_3$ | H | H | H |
| A-24 | O | NH | $HOCH_2-CH(OH)-$ | H | K |
| A-25 | O | S | H | H | H |
| A-26 | O | S | $HOCH_2-CH(OH)-$ | H | H |
| A-27 | O | S | $CH_3-CH(OH)-$ | H | H |
| A-28 | S | S | H | H | H |
| A-29 | S | S | $HOCH_2-CH(OH)-$ | H | H |
| A-30 | S | S | H | H | H |

These compounds are representatively ascorbic acid and erythorbic acid, and their salts, or derivatives derived therefrom, and they are commercially available or easily synthesized according to known synthetic method.

The developing agent referred to here is a compound which occupies 50% or more in mol among the compounds capable of developing silver halide in the developer The compound represented formula (A) is employed as concentration in the developer of 0.1 to 1 mol/l, preferably.

In the present invention, the combined usage of the developing agent consisting of the ascorbic acid and it's derivative together with the developing agent consisting of 3-pyrazolidone derivative (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone), or aminophenol derivative (e.g., o-aminophenol, p-aminophenol, N-methyl-o-aminophenol, N-methyl-p-aminophenol, 2,4-diaminophenol), or dihydroxybenzene derivative (e.g., hydroquinonemonosulfonate, sodium hydroquinonemonosulfonate, potassium 2,5-hydroquinonedisulfonate), is preferable. In case of the combined usage, the added amount of the developing agent consisting of 3-pyrazolidone derivative, aminophenol derivative or dihydroxybenzene is usually 0.01 to 0.2 moles per a liter of developer composition. Especially the combination of the ascorbic acid and it's derivative with 3-pyrazolidone derivative, and the combination of the ascorbic acid and it's derivative with 3-pyrazolidone derivative and dihydroxybenzene derivative is preferably used.

It is possible to add to a developer composition an alkali agent (sodium hydroxide and potassium hydroxide,), a pH buffer agent (e.g., carbonate, phosphate, borate, acetic acid, citric acid and Alkanol amine). As the pH buffer agent, carbonate is preferable, and an added amount of it is preferably 0.2 to 1.0 moles per a liter, more preferably 0.3 to 0.6 moles.

Sulfites as a preservative agent is preferably employed in case a compound represented by formula (A) is utilized. Preferable amount is 0.02–0.3 mol/l, more preferably 0.1–0.2 mol/l.

In case of need, a dissolving aid (e.g., polyethyleneglycol and its ester, Alkanol amine), a sensitizing agent (e.g., nonionic surfactant including polyoxyethylene and quaternary ammonium compound), a surfactant, anti-foaming agent and antifoggant (e.g., halogenide such as potassium bromide or sodium bromide, nitrobenzindazole, nitrobenzimidazole, benztriazole, benzthiazole, tetrazole and thiazole), a chelating agent (e.g., ethylenediaminetetraacetic acid or its alkali metal salt, nitrilotriacetate and polyphosphate), a development accelerating agent (e.g., compounds described in U.S. Pat. No. 2,304,025 and Japanese Patent Examined Publication No. 45541/1972), a hardening agent (e.g., glutaraldehyde or addition product of its metabisulfite), or an anti-foaming agent.

The pH of the developer composition is preferably adjusted to 7.5 to 10.5 with alkaline agents, more preferably 8.5 to 10.4.

As a fixing solution, any one which is popularly known in the art can be used. The pH of the fixing solution is usually between 3.0 and 8.0. As the fixing agent, for example, thiosulfates such as sodium thiosulfate, potassium thiosulfate, ammonium thiosulfate, and thiocyanates such as sodium thiocyanate, potassium thiocyanate, ammonium thiocyanate and other organic sulfur compounds which are capable of producing a stable silver complex salts and are known in the art as a fixing agent can be used.

Into the fixing solution, a compound which functions as a hardening agent, including, for example, water-soluble aluminum salts such as aluminum chloride, aluminum sulfate, potassium alum, aldehyde compounds (such as glutaraldehyde or its sulfite adduct, etc.) may be added.

The fixing solution may contain, if necessary, preservatives such as sulfites or metasulfites; pH buffers such as acetic acid, citric acid, etc.; pH adjuster such as sulfuric acid, or chelating agents capable of softening hard water, etc.

In the present invention concentration of the ammonium ion in the fixing composition is 0.1 mol or less per 1 l of the fixing composition.

The concentration of the ammonium ion in the fixing composition is preferably 0–0.05 mol/l. Sodium thiosulfate may be employed in place of ammonium thiosulfate as the fixing agent, or ammonium thiosulfate and sodium thiosulfate may be employed in combination.

In the present invention concentration of the acetic acid ion in the fixing composition is 0.33 mol or less per 1 l of the fixing composition. Source of the acetic acid can be selected optionally in the present invention as far as it dissociates acetic acid ion in the fixing composition. Preferable examples include acetic acid or it salt of lithium, potassium, sodium ammonium etc., and particularly preferable are sodium salt and ammonium salt. The concentration of the acetic acid ion in the fixing composition is 0.22 mol pr less, particularly less than 0.13 mol/l, whereby generation of acetic acid gas can be prevented remarkably. The most preferable embodiment is no acetic acid is contained.

The fixing agent contains a salt of citric acid, tartaric acid, malic acid, succinic acid or an optical isomer thereof. As the salt of these, lithium salt, potassium salt, sodium salt, and ammonium salt; hydrogen lithium salt, hydrogen potassium salt, hydrogen sodium salt, and hydrogen ammonium salt of tartaric acid; ammonium potassium salt of tartaric acid; and sodium potassium salt of tartaric acid can be mentioned. The preferable examples are citric acid, malic acid and tartaric acid, or their salt. The most preferable example is malic acid and its salt.

It is preferable to be subjected to water washing by water containing an oxidizing agent or a bactericide in the present invention.

As an oxidizing agent used in the invention, are cited metallic or non-metallic oxide, oxygen acid or its salt, peroxide, and a compound including organic acid. From the viewpoint of discharging from draining pipe, as the aforesaid oxygen acid, sulfuric acid, nitrous acid, nitric acid and hypochlorous acid etc. are preferable, as the aforesaid peroxide, hydrogen peroxide and Fenton's reagent are especially preferable. The most preferable one is hydrogen peroxide.

The oxidizing agent is preferably supplied in a form of concentrated liquid or solid agent from the viewpoint of distribution. Preferable is concentrated liquid which contains oxidizing component of 0.1 to 10 mol/l, particularly preferably 0.5 to 2.0 mol/l.

Concentrated liquid or solid oxidizing agent can be supplied by mixing with washing water i. They can be mixed before entering a wash tank, or may be mixed with washing water in the wash tank.

Replenishment timing accords with constant replenishment with every unit time or with every processed amount of the light-sensitive material by detecting the processed amount.

Adding amount of the oxidizing agent is preferably 0.5 to 10 mole equivalent to the amount of thiosulfate salt carried over by the light-sensitive material, more preferably 0.5 to 3 mole equivalent.

In this invention, the oxidizing agent is used in combination with preserving agent and bactericide so that the oxidizing agent functions more effectively.

As examples of the bactericides used in the invention which do not affect adverse effect on photographic characteristics, are thiazolyl benzimidazole derivative, isothiazolone derivative, chlorophenol derivative, bromophenol derivative, thiocyanic acid derivative, isothiane acid derivative, acid azide derivative, diazine derivative, triazine derivative, thiourea derivative, alkylguanidine derivative, quaternary ammonium salt, organic tin compound, organic zinc compound, cyclohexylphenol derivative, imidazole derivative, benzimidazole derivative, sulfamide derivative, active halogen compound such as sodium chlorinated isocyanuric acid, chelate compound, sulfite compound, and antibiotics such as anti-bacteria and anti-mould represented by penicillin. Other bactericides described in "Water Quality Criteria" written by L. E. West in Phot. Sci. and Eng., vol. 9, No. 6; various bactericides described in JP-A Nos. 57-8542, 58-105145, 59-126533, 55-111942 and 57-157244; compounds described in "Boukin boubai no Kagaku" (Chemistry of antibact. and antifung.) written by Hiroshi Horiguchi, Sankyou Syuppan (1982), "Handbook of boukin boubai gijutu" (Technical handbook of antibact. and antifung.) edited by Japan antibact. and antifung. Society Gihoudo (1886), can be used.

The exemplified compounds are shown below, but are not limited thereto.

1. 5-chloro-2-methyl-4-isothiazoline-3-one
2. 2-(4-thiazolyl)-benzimidazole
3. Methyl isothianate
4. 3,5-dichloro-4'-fluoro-thiocarbanilide
5. 4-chloro-3,5-dimethylphenol
6. 2,4,6-trichlorophenol
7. Sodium dehydroacetic acid
8. Sulfanilamide
9. 3,4,5-tribromosalicylanilide
10. Potassium sorbate
11. Benzalkonium chloride
12. 1-bromo-3-chloro-5,5-dimethylhydantoin
13. Monochloroacetamide
14. Monobromoacetamide
15. Monoiodoacetamide
16. Benzimidazole
17. Cyclohexylphenol
18. 2-octyl-isotiazoline-3-one
19. Ethylenediaminetetraacetic acid
20. Nitrilo-N,N,N-trimethinephosphonic acid
21. 1-hydroxyethane-1,1-diphosphonic acid
22. Ethlenediamine-N,N,N',N'-tetramethylenephosphonic acid
23. Sodium chlorinated isocyanurate
24. 2-methyl-4-isothiazoline-3-one
25. 10,10'-oxybisphenoxy arsine
26. 1,2-benzisothiazoline-3-one
27. Thiosalicylic acid The synthesizing methods and applied examples in other field of these exemplified compounds are described in U.S. Pat. Nos. 2,767,172, 2,767,173, 2,767,174, 2,870,015, U.K. Patent No. 848,130, France Patent No. 1,555,416. Some of them are in the market, and those with trade names such as Predentol ON, Permachem PD, Topside 800, Topside EG5, Topside 300, Topside 600 (all of them are produced by Permachem Asia Co., Ltd.), Fineside J-700 (produced by Tokyo Finechemical Co., Ltd.), Prozel GXL (produced by I.C.I. Co., Ltd.) are available.

In cases where the above mentioned bactericides are supplied in washing water, adding amount is preferably 0.01 to 50 g/l, more preferably 0.05 to 20 g/l. In cases where the above mentioned bactericides are supplied in cleaning composition, adding amount is preferably 0.1 to 50 g/l, more preferably 1 to 20 g/l.

Compounds having polyalkylene oxide chain represented by the following formula Po are preferable for a preserving agent employed in the present invention.

$$\text{Po: } HO—(C_2H_4O)n—(C_3H_6O)m—(C_2H_4O)l—H$$

A compound containing polyalkyleneoxide chain represented by the general formula Po used in the invention is the compound obtained from addition polymerization of propyleneglycol as a hydrophobic group and ethyleneoxide. In this invention the compound having an average molecular weight of 2000 to 8500 is preferable, and content of molecular weight of polypropyleneglycol (PPG) in this compound is preferably 1400 to 2400. Amount of ethyleneoxide in the total weight of the molecule is preferably 40 to 85%. Particularly, in the formula (1), n+1 is preferably about 150, m is preferably about 30. As the compound which meets these criteria, for example, non-ionic surfactant of trade name Pluronic Series, produced by Asahi Denka Co., Ltd. is usable, and exemplified surfactants listed below are preferable.

TABLE 1

| Compound No. | Trade name | Average molecular weight | PPG molecular weight | Ethyleneoxide in total molecule (Wt %) |
|---|---|---|---|---|
| 1 | Pluronic L44 | 2,200 | 1,200 | 40 |
| 2 | Pluronic L62 | 2,500 | 1,750 | 20 |
| 3 | Pluronic L64 | 2,900 | 1,750 | 40 |
| 4 | Pluronic L68 | 8,350 | 1,750 | 80 |
| 5 | Pluronic F68LF | 7,700 | 1,750 | 80 |

Adding amount of the compound containing polyalkyleneoxide chain mentioned above is 1 to 1000 ppm to washing water, preferably 10 to 100 ppm, and in the case of using a purification agent, 0.01 to 10% to the oxidizing agent, preferably 0.1 to 5%.

As examples of the preserving agents used in the invention, are cited phosphoric acid, barbituric acid, urea, acetanilide, oxyquinoline, salicylic acid, quinolic acid, and their derivatives and their salts. The preferable examples are salicylic acid, its derivative and their salts.

The cleaning agent employed in the invention preferably contains a chelating agent having chelate stability constant with calcium ion of 0.8 to 5.0. The chelate stability constant with calcium is logarithm of the formation constant when one calcium ion bonds to one of chelating agent, which is measured under the condition of temperature at 20° C. and ionic strength of 0.2. Examples of the cleaning agent are concretely organic acids such as maleic acid, gluconic acid, glucoheptanoic acid, tartaric acid, citric acid, tartaric acid acid, salicylic acid, ascorbic acid, of erythorbic acid, glycin, amino polycarboxylic acids such as ethylenediamine tetraacetic acid, diethylenetriaminepentaacetic acid, of nitrilotriacetic acid, and those derivatives and their salts. Gluconic acid and citric acid are preferable among the organic acids, and, ethylenediamine tetraacetic acid, diethylenetriaminepentaacetic acid are preferable among aminopolycarboxylic acids. These compounds are employed in an amount of 0.005 to 0.2 mol, preferably 0.005 to 0.1 mol per wash water 1 l.

In case that the washing time is not more than 20 sec., the advantage of the invention is remarkable, and preferably 16 sec or less, particularly preferably 12 sec. or less.

In this invention, the solid processing composition of the fixing replenishment solution is the solid processing composition in the form of a tablet, a pellet or granules, and optionally treated with moisture proof. The solution in the form of paste or slurry is in semi-liquid form and inferior in storage stability. Any form of the solid processing composition which is accompanied with a danger in transferring it and is regulated to transfer it is not allowed to be used in this invention.

The powder is referred to an aggregate comprised of fine crystal particles. The granules is referred to granular material prepared by subjecting the powder to granulating process, having particle sizes of 50–5000 μm. The tablet is one prepared by subjecting the powder or granules to compression molding to a given form.

Among the above mentioned solid processing compositions, the tablet is preferably used because it is accurate in replenishment and handled easily.

The processing composition can be solidified in any manner such that the processing composition in the form of a concentrated solution or fine powder or granules, is mixed with a water soluble binding agent and then the mixture is molded, or the water soluble binding agent is sprayed on the surface of temporarily-molded processing composition to form a covering layer.

A preferred tablet-making process is to form a tablet by compression-molding after granulating powdery processing composition. Above mentioned tablet is improved in solubility and storage stability, resulting in the stability of photographic characteristics, compared with the so lid processing composition formed by only mixing solid processing components and compression-molding components.

Granulation can be performed by the known method, such as rolling granulation, extrusion granulation, compression granulation, grinding granulation, stirring granulation, fluidized bed granulation and spray-drying granulation. It is preferred that the average grain size of the granules is 100 to 800 μm and preferably 200 to 750 μm. In particular, 60% or more of the granules is with a deviation of ±100 to 150 μ. As hydraulic press machine, any conventional compression molding machine, such as a single-engine compression molding machine, rotary-type compression machine, briquetting machine, etc. may be employed to form a tablet. Compression-molded (compression-tabletted) solid processing composition may take any form and is preferably in a cylindrical form from the point of productivity, easy handling and problems of powder dust in cases when handled by a user.

It is further preferred to granulate separately each component, such as an alkali agent, reducing agent and preservative in the above process.

The processing composition in the form of a tablet can be prepared according to methods, as described in JP-A Nos. 51-61837, 54-155038, 52-88025, and British Patent 1,213,808. The granular processing composition can also be prepared according to methods, as described in JP-A Nos. 2-109042, 2-109043, 3-39735 and 3-39739. The powdery processing composition can be prepared according to methods, as described in JP-A No. 54-133332, British Patent 725,892 and 729,862 and German Patent 3,733,861.

In cases where the above mentioned solid processing composition is in the form of tablet, its bulk density is preferably 1.0 to 2.5 g/cm$^3$ from the viewpoint of solubility and the point of effects of the invention. When being not less than 1.0 g/cm$^3$, it is advantageous for strength of the solid composition; and when being not more than 2.5 g/cm$^3$, it is advantageous for solubility. In cases where the composition is in the form of granules or powder, the bulk density is preferably 0.40 to 0.95 g/cm$^3$.

The solid processing composition can be used for photographic processing composition at least developing composition and fixing composition, and further other photographic processing composition such as rinsing composition. The developing composition and fixing composition are free from the regulation of liquid dangerous substance. Most preferably all of the processing compositions are solidified, but at least developing composition and fixing composition are preferably solidified.

Only a part of processing component in the solid processing composition used may be solidified. It is, however, preferable that the whole components of these processing chemicals are solidified. It is also preferable that the components thereof are each molded into a separate solid processing chemical and then individually packed in the same form. It is further preferable that the components are packed in series in the order of periodically and repeatedly adding them from the packages.

A preferable embodiment of a solid processing chemical applicable to the invention is that all of an alkali agent, a developing agent and a reducer are solidified when solidifying a developer, and that, when a developer is tableted, the numbers of the tablets may be not more than 4 tablets and, preferably, a single tablet. When the solid processing chemicals are solidified separately into not less than 2 tablets, it is preferable to pack these plural tablets or granules in the same package.

When a developer composition is solidified, it is preferable embodiment of the invention that an alkaline agent and reducing agent are all solidified in not more than three tablets, most preferably one or two tablets. When the composition is solidified in two or more composition, the plural tablets or granulated compositions are preferably packed in the same package.

As the packaging material for the solid processing composition, a synthesized resin material such as polyethylene including one prepared by high-pressure method or one prepared by low-pressure method, an unstretched or stretched polypropylene, polyvinyl chloride, polyvinyl acetate, Nylon (stretched or unstretched), polyvinylidene chloride, polystyrene, polycarbonate, Vinylon, Eval, polyethylene terephthalate (PET), polyesters other PET, hydrochloric acid rubber, acrylonitrile/butadiene copolymer, epoxy-phosphoric acid type resin such as polymers described in JP-A Nos. 63-63037 and 57-32952, and pulp.

Although two or more of the above-mentioned films are preferably laminated to use for packaging the solidified processing composition, a single film or a film on which another material is coated are usable.

It is more preferably to provide various type of gas barrier layer such as an aluminum foil or an aluminum evaporated synthetic resin layer between the above-mentioned resin layers.

The oxygen permeability of the packaging material is preferably not more than 50 ml/m$^2$·24 hr·atm, more preferably 30 ml/m$^2$·24 hr·atm, (at 20° C. and 65% RH) for raising the stability of the solid processing component and preventing stain formation.

The total thickness of the above laminated layers or the single layer is 1 to 3,000 $\mu$m, more preferably 10 to 2,000 $\mu$m, further preferably 50 to 1,000 $\mu$m.

The above-mentioned synthetic resin film may be a single macromolecular resin layer or a laminated layer composed of two or more macromolecular resin layers.

When the processing composition is packaged or bound by a water-soluble film or a binder, a water soluble film or a binder composed of a material of polyvinyl alcohol type, methyl cellulose type, polyethylene oxide type, starch type, polyvinylpyrrolidone type, hydroxypropyl cellulose type, pullulan type, dextran type, gum arabic type, polyvinyl acetate type, hydroxyethyl cellulose type, carboxyethyl cellulose type, sodium salt of carboxymethylhydroxyethyl cellulose type, poly(alkyl)oxazoline type and polyethylene glycol type is preferably usable. Among them, polyvinyl alcohol type and pullulan type are particular preferred from the viewpoint of effects of covering and binding.

The thickness of the above-mentioned water-soluble film is preferably 10 to 120 $\mu$m, more preferably 15 to 80 $\mu$m, particularly preferably 20 to 60 $\mu$m from the view point of the storage stability of solid processing composition, dissolving time of the water-soluble film and the crystal precipitation in an automatic processor.

The water-soluble film is preferably has a thermoplastic property, by which the film can be easily sealed by heat or ultrasonic adhesion, and the covering effect of the film is enhanced.

The tensile strength of the water-soluble film is preferably 0.5×106 to 50×106 kg/m$^2$, more preferably 1×106 to 25×106 kg/m$^2$, particularly 1.5×10 to 10×106 kg/m$^2$. The strain strength is determined by the method described in JIS Z-1521.

The photographic processing composition covered or bound by the water-soluble film or binder is preferably packaged by a moisture-proof packaging material to protect from the damage caused by accidental contact to the moisture of the air such as high humidity, rain and fog, or to water spattered or adhered on hand in the course of storage, conveying and handling. A film having a thickness of 10 to 150 $\mu$m is preferred as the moisture-proof packaging material. The moisture-proof packaging material is preferably one selected from a film of polyolefin such as polyethylene terephthalate, polyethylene or polypropylene, a craft paper given a moisture-proof ability by polyethylene, wax paper, moisture-proof cellophane, glassine paper, polyester, polystyrene, polyvinyl chloride, polyvinylidene chloride, polyamide, polycarbonate or acrylonitrile, and a foil of metal such as aluminum and metallized polymer film. A complex material composed of the above-mentioned materials is also usable.

A degradable plastic, particularly a biodegradable or photodegradable plastic, is preferably usable.

The above-mentioned biodegradable plastic includes one composed of a natural macromolecular substance, a polymer produced by a microorganism, a synthetic polymer having a high bio-decomposability. The photodegradable plastic includes one having a group in the main chain which causes cleavage of the chain when UV exits the group. A plastic having both of the functions of photodecomposition and bio-decomposition is preferably usable. Concrete examples of the above-mentioned are described below.

Bio-degradable Plastic (1) Natural macromolecular substance

Polysaccharides, cellulose, polylactic acid, chitin, chitosan, polyamino acid and decorative thereof (2) Polymer produced by microorganism "Bipol" composed of copolymer of 3-hydroxy-butyrate and 3-hydroxyvalerate (PHB-PHV) and cellulose produced by microorganism (3) Synthetic polymer having a high bio-decomposability Polyvinyl alcohol, polycaprolactone and a copolymer or mixture thereof (4) Combination of bio-degradable natural micromolecular substance with plastic A natural macromolecular substance having a high biodegradability such as starch and cellulose is combined with a plastic for giving a shape-collapsing ability.

Photo-degradable Plastic (5) A plastic in which a carbonyl group is introduced for giving a photo-collapsing ability. An UV absorbent may be added for accelerating the collapse of the plastic.

As the above-mentioned degradable plastic, ones described in "Kagaku to Kogyo" (Science and Industry), vol. 64, No. 10, p.p. 478–484, 1990, "Kinou Zairyo" (Functional Material), p.p. 23–34, July 1990, are usually usable. Degradable plastics available on the market such as Biopol (manufactured by ICI Co.), Eco (Manufactured by Union Carbide Co.), Ecolite (Manufactured by Eco Plastic Co.) and Ecostar (manufactured by St. Lawrence Starch Co.) are usable.

The moisture permeability of the above moisture-proof packaging material is preferably not more than 10 g·mm/m$^2$·24 hr, more preferably not more than 5 g·mm/m$^2$·24 hr.

For satisfying the demand for reducing the amount of waste liquid, processing is conducted by replenishing with predetermined amount of proportional to the light-sensitive material. The replenishing amount for fixer is preferably not more than 300 ml, per 1 $m^2$.

Preferably 30 to 250 ml per 1 $m^2$. The replenishing amount for developer is preferably not more than 250 ml per 1 $m^2$, and more preferably 30 to 200 ml per 1 $m^2$. The replenishing amount for fixer and the replenishing amount for developer means the amount replenished. Concretely, in case of replenishing the same liquid as developer liquid or fixer liquid, the amount is the supplied amount. In case of supplying dilute liquid of concentrated developer liquid or fixer liquid with water, the amount is the sum of the concentrated liquid and the water. In case of supplying liquid which is prepared by dissolving the developer solid composition or fixer solid composition in water, the amount is the sum of the volume of the solid composition and the water. In case of supplying the solid composition and water separately, the amount is the sum of the volume of the solid processing composition and the water. In case of supplying the solid processing composition, it is preferred to represent sum of the volume of the solid composition to be put into a tank of the processing machine and the volume of water to be added to the tank. The composition of developer replenisher or fixer replenisher may be the same or different liquid composition as the liquid in the tank, or solid composition.

Temperature at the steps of development, fixing, and washing and/or stabilizing is preferably within the range of 10 to 45° C., and the temperature may be separately controlled for each of the steps.

The total processing time from the time of insertion of the front of film into an automatic processor to coming out of from the drying zone (dry to dry), is preferably 10 to 70 seconds for satisfying the demand for reducing the processing time. The total processing time includes all the time necessary for processing a black-and-white light-sensitive material, in concrete, includes the time necessary for all processing of, for example, the development, fixing, washing, stabilizing and drying, namely dry to dry. When the total processing time is less than 10 seconds, a satisfactory photographic property cannot be obtained since desensitization and lowering in contrast are occurred. The total processing time (dry to dry) is more preferably 30 to 60 seconds. Further, it is preferred that the developing time is not more than seconds for stably running the processing of a lot of light-sensitive material of 100 $m^2$ or more.

The developing or fixing process may be conducted in such a way as immersing the photographic material in the processing composition, spraying the processing composition to the photographic material or coating the processing composition to the photographic material.

In the automatic processing machine drying zone employing heat conductive substance of 60° C. or higher (such as heat roller at 60 to 130° C.) or substances capable of emitting radiation with temperature higher than 150° C. (more preferably, higher than 250° C.), the following substances can be mentioned: tungsten, carbon, tantalum, Nichrome, a mixture of zirconium oxide, yttrium oxide and thorium oxide, carbon silicate, molybdenum disilicate. Further, methods of directly applying electricity to a radiating element such as tungsten, carbon, Nicrome, a mixture of zirconium oxide, yttrium oxide and thorium oxide to heat and emit radiation, or conducting thermal energy from a resistance pyrogeneous substance to a radiation emissive substance such as copper, stainless steel, nickel and various types of ceramics, to generate heat or radiate infrared rays may also be used to demonstrate the advantage of the present invention effectively.

In this invention, the automatic processor having the method and structure as described below can be preferably used.

(1) Deodorization apparatus: JP-A No. 64-37560, 544 page 2 upper left to 545 page 3 upper left.

(2) Processing method for waste solution: JP-A No. 2-64638, 388 page 2 lower left to 391 page 5 lower left.

(3) Rinsing bath between developing bath and fixing bath: JP-A No. 4-313749, page 18 paragraph 0054 to page 21 paragraph 0065.

(4) Water replenishing method: JP-A No. 1-281446, 250 page 2 lower left to lower right.

(5) Method for controlling drying wind of automatic processor by detecting an external temperature: JP-A No. 1-315745, 496 page 2 lower right to 501 page 7 lower right, JP-A No. 2-108051, 588 page 2 lower left to 589 page 3 lower left. (6) Silver recovery method from fixer waste solution: JP-A No. 6-27623, page 4 paragraph 0012 to page 7 paragraph 0071.

EXAMPLES

The invention is described below referring examples, embodiments of the invention are not limited thereto.

Example 1

(Preparation of silver halide emulsion A)

To a solution A were simultaneously added a silver nitrate aqueous solution B and an water soluble halide solution C for 30 minutes while keeping at pH 3.0, at the temperature of 40° C. The resulting emulsion was proved to be an emulsion comprising cubic type silver halide grains having an average diameter of 0.18 $\mu$m, comprised of 70 mol % of silver chloride and 30 mol % of silver bromide. In the course of preparing emulsion, pAg was 160 mV before adding and 100 mV when the adding was finished.

Thereafter, by ultrafiltration unnecessary salts were removed, then to the resulting solution 15 g of gelatin per mol of silver was added and the pH of the solution was adjusted at pH 5.7 and thus obtained solution was dispersed for 30 min. After dispersion, $4\times10^{-4}$ mol of chloramine T per mol of silver was added. The pAg of thus obtained emulsion was 190 mV (at 40° C.).

| | | |
|---|---|---|
| A: | Ossein gelatin | 25 g |
| | Nitric acid (5%) | 6.5 ml |
| | Ion-exchanged water | 700 ml |
| | $Na_2[RhCl_5(H_2O)]$ | 0.02 mg |
| B: | Silver nitrate | 170 g |
| | Nitric acid (5%) | 4.5 ml |
| | Ion-exchanged water | 200 ml |
| C: | NaCl | 47.5 g |
| | KBr | 51.3 g |
| | Ossein gelatin | 6 g |
| | $Na_3[IrCl_6]$ | 0.15 mg |
| | Ion-exchanged water | 200 ml |

To the obtained emulsion were added $1.5\times10^{-3}$ mol per mol of silver of 4-hydroxy-6-methyl-1,3,3a,7-tetrazaindene and $8.5\times10^{-4}$ mol per mol of silver of potassium bromide, and adjusted to be pH 5.6 and EAg 123 mv. To the resulting emulsion were added flower of sulfur in an amount of $2\times10^{-5}$ mol of as sulfur atom in a fine solid dispersion and $1.5\times10^{-5}$ mol of chloroauric acid per mol of silver and the resulting emulsion was chemically ripened at 60° C. for 80 min. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and $1.5\times10^{-3}$ mol per mol of silver of potassium iodide were added. After the emulsion was cooled to 40° C., to this emulsion was added sensitizing dyes S-1 and S-2 in an amount of $2\times10^{-4}$ mol per mol of silver in each.

Using thus obtained emulsion A, on one side of a subbed support were simultaneously coated 1st layer, and 2nd layer and made cool and set (Emulsion Composition A).

On a subbed support opposite to the emulsion layer a backing layer was coated and cooled and set at −1° C., and then both sides were simultaneously dried. Thus sample were obtained. Emulsion Composition B is referred to the similar way to Emulsion Composition A except containing no hydrazine derivative.

(Support)

Both of the surface of a biaxially stretched polyethylene terephthalate support of thickness of 100 μm was subjected to 30 W/(m$^2$·min.) of corona discharge, and a subbing layer having the following composition was coated on both side of the support and dried for 1 minute at 100° C.

| | |
|---|---|
| 2-hydroxyethyl methacrylate (25)-butyl acrylate (30)-t-butyl acrylate (25)-styrene (20) copolymer (numbers denote weight ratio) | 0.5 g/m$^2$ |
| Surfactant A | 3.6 mg/m$^2$ |
| Hexamethylen-1,6-bis(ethyleneurea) | 10 mg/m$^2$ |

(Electro-conductive layer)

On the subbed polyethylene terephthalate support, 10 W/(m$^2$·min.) of corona discharge was applied, and an electro-conductive layer having the following composition was coated with a speed of 70 m/min. by a roll-fit coating pan and an air knife on one side of the support and dried for 90 seconds at 140° C.

| | |
|---|---|
| Water-soluble electroconductive polymer B | 0.6 g/m$^2$ |
| Particles of hydrophobic polymer C | 0.4 g/m$^2$ |
| Polyethylene oxide compound (M.W.: 600) | 0.1 g/m$^2$ |
| Hardener E | 0.1 g/m$^2$ |

(First emulsion layer)

| | |
|---|---|
| Gelatin | 1.0 g |
| Silver halide emulsion A (Converted silver amount) | 3.3 g |
| Hydrazine derivative H-34 | 0.015 g |
| Hydrazine derivative H-39 | 0.020 g |
| 5-Nitroindazole | 0.01 g |
| 2-Mecaptohypoxanthine | 0.02 g |
| Suspension polymerization product of colloidal silica 75 wt %, vinylacetate 12.5 wt % and vinylpyvalinate 12.5 wt % | 1.4 g |
| Dextran (average molecular weight; 65,000) | 0.10 g |
| 4-Mercapto-3,5,6-fluorophthalic acid | 0.05 g |
| Sodium polystyrenesulfonate (average molecular weight; 500,000) | 0.015 g |

pH of the coating composition was 5.8.

Second Layer (Protective layer)

| | |
|---|---|
| Gelatin | 0.90 g |
| Dextran (average molecular weight; 65,000) | 0.20 g |
| Resorcinol | 0.15 g |
| 1-Phenyl-4-methyl,4'-hydroxymethyl-3-Pyrazolidone | 0.005 g |
| Nucleation accelerator Na-21 | 0.20 g |
| Lubricant | shown in Table 2 |
| Bactericide Z | 0.005 g |
| Sodium polyoxyethylenelaurilether sulfonate | 0.010 g |

-continued

| | |
|---|---|
| Sodium dihexylsulfosuccinate | 0.015 g |
| Silica (average diameter 5 μm) | 0.01 g |
| Silica (average diameter 8 μm) | 0.015 g |
| Hardening agent (1) | 0.15 g |

(Backing Layer)

| | |
|---|---|
| Gelatin | 1.8 g |
| F-1 | 0.080 g |
| F-2 | 0.050 g |
| F-3 | 0.020 g |
| Suspension polymerization product of colloidal silica 75 wt %, vinylacetate 12.5 wt % and vinylpyvalinate 12.5 wt % | 0.7 g |
| Sodium polystyrenesulfonate | 0.010 g |
| Hardening agent (2) | 0.05 g |

(Backing Protective Layer)

| | |
|---|---|
| Gelatin | 1.8 g |
| Matting agent (Monodispersed particle size distribution polymethylmethacrylate, average diameter 3 μm) | 0.045 g |
| Sodium polyoxyethylenelaurilether sulfonate | 0.005 g |
| Sodium dihexylsulfosuccinate | 0.005 g |
| Hardening agent | 0.15 g |

S-1

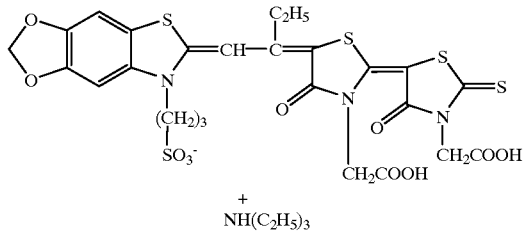

S-2

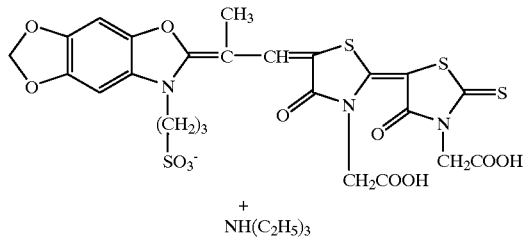

Hardening Agent (1)

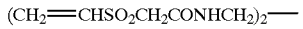

Hardening Agent (2)

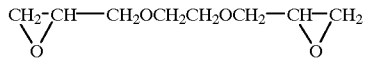

Bactericide Z

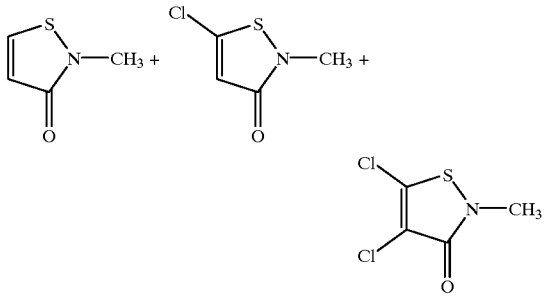

Water-soluble Electro-conductive Polymer B

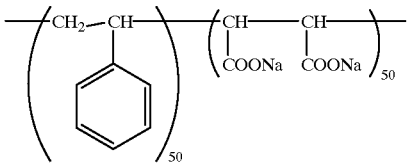

Hydrophobic Polymer C

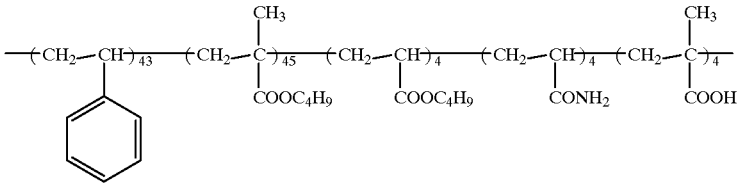

Hardener E

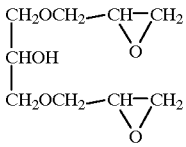

Surfactant A

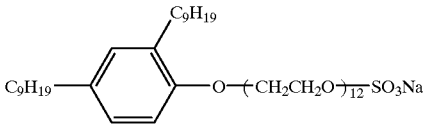

F-1

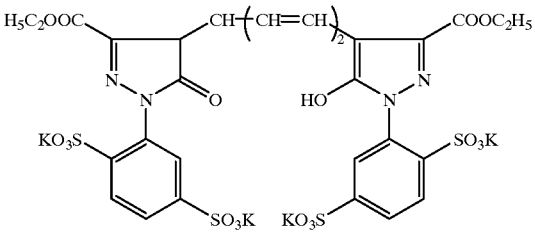

F-2

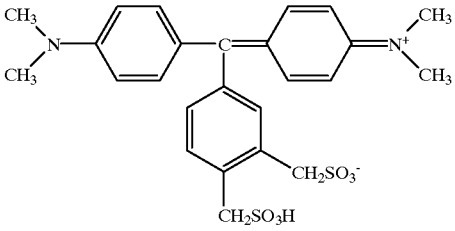

-continued

F-3

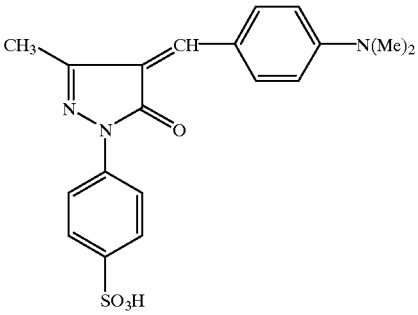

(Developer HQ)

| | |
|---|---|
| Pentasodium diethylenetriaminepentaacetate | 1 g |
| Sodium sulfite | 30 g |
| Potassium carbonate | 65 g |
| 1-Phenyl-4-methyl,4'-hydroxymethyl-3-Pyrazolidone | 1.5 g |
| Hydroguinone | 40 g |
| 1-phenyl-5-mercaptotetrazole | 0.025 g |
| Potassium bromide | 4 g |
| 5-methylbenzotriazole | 0.21 g |
| 2,5-dihydroxybenzoic acid | 5 g |

-continued

| | |
|---|---|
| 8-mercaptoadenine | 0.07 g |
| KOH to make pH 9.8 | |
| Water to make 1 l. | |

(Developer EA)

| | |
|---|---|
| Pentasodium diethylenetriaminepentaacetate | 1 g |
| Sodium sulfite | 30 g |
| Potassium carbonate | 53 g |
| Potassium hydrogencarbonate | 17 g |
| 1-Phenyl-4-methyl,4-hydroxymethyl-3-Pyrazolidone | 1.5 g |
| Sodium erythorbate monohydrate | 40 g |
| 1-phenyl-5-mercaptotetrazole | 0.025 g |
| Potassium bromide | 4 g |
| 5-methylbenzotriazole | 0.21 g |
| 2,5-dihydroxybenzoic acid | 5 g |
| 8-mercaptoadenine | 0.07 g |
| KOH to make pH 9.8 | |
| Water to make 1 l. | |

(Fixer Composition, per 1 liter of working liquid)

| | |
|---|---|
| Sodium thiosulfate | 200 g |
| Sodium sulfite | 22 g |
| Sodium gluconate | 5 g |
| 3 Sodium citrate dihydrate | 12 g |
| Citric acid | 12 g |
| Sulfuric acid to make pH 5.4 | |
| Water to make 1 liter. | |

(Rinsing liquid)

Rinsing liquid is prepared by adding 8.8 ml of the following cleaning agent to 1 liter of tap water was added in a rinsing tank.

(Preparation of Cleaning Agent)

| | |
|---|---|
| Deionized water | 800 g |
| Salicylic acid | 0.1 g |
| Hydrogen peroxide (35%) | 171 g |
| Pluronic F-68 | 3.1 g |
| Hoxite F-150 | 15 g |
| DTPA 5Na | 10 g |
| Deionized water to make 1 liter. | |

(Processing condition)

| | Temperature | Time |
|---|---|---|
| Development | 38° C. | 15 sec. |
| Fixing | 37° C. | 15 sec. |
| Rinsing | 25° C. | 15 sec. |
| Drying | 50° C. | 15 sec. |

(Replenishing amount of rinsing liquid)

| | |
|---|---|
| Tap water | 2.31 ml/m$^2$ |
| Cleaning agent | 20 ml/m$^2$ |

Measuring Sensitivity

Sample thus obtained was subjected to wedge exposure using He-Ne laser of 633 nm, and then processed by print making automatic developing processor LD-M1060, manufactured by Dainippon Screen Mfg. Co. Ltd., using the above mentioned processing composition, above mentioned developer liquid, fixer liquid, and cleaning liquid containing oxidizing, sensitivity was measured. In this instance, sensitivity was shown as a relative value with reference to the sensitivity of sample No. 1 as 100. Dot Quality DQ Employing FT-R5055 manufactured by Dainippon Screen Mfg. Co. Ltd., 100 lines per inch and 50% of tint screen was putout by 1,200 dpi on the samples, which were processed in the same way as measuring sensitivity mentioned above, and the resulted samples were evaluated by eyes view for 5 ranks. Rank 5 is the best, 3 or more are acceptable in practical use, Kinetic Friction Coefficient Kinetic friction coefficient was measured by means of HEIDON-14 manufactured by Shinto Chemical Co., Ltd., after the standing for two hours in a condition of 23° C., 50%. The measurement was conducted in the condition of weight of 100 g and conveying speed of the sample 20 mm/sec by employing sapphire scratching needle having 1.0 mm diameter.

Abrasion

Employing FT-R5055 mentioned above, 50% of tint screen was putout by 1,200 dpi in 610×820 mm size, with varied exposing speed, i.e., film conveying speed, the resulting samples were processed in the same developing condition described above. Samples were evaluated by eye view. The result was shown as number of samples on which black pressure marks appears among 100 samples of 610×820 mm size. Impedance of each sample, measured in the same way as Example 1, was $245\times10^4$ Ω.

TABLE 2

| Sample | Emulsion | Lubricant | | Transfer speed | | | | Kinetic friction | Abrasion |
|---|---|---|---|---|---|---|---|---|---|
| No. | Composition | Species | mg/m$^2$ | mm/sec | Developer | Sensitivity | DQ | coefficient | (among 100 pages) |
| 1 | A-2 | 3-2 | 12 | 25 | HQ | 100 | 1 | 0.28 | 3 |
| 7 | A-1 | 3-2 | 12 | 10 | EA | 150 | 5 | 0.28 | 5 |
| 8 | A-1 | 3-2 | 12 | 15 | EA | 150 | 5 | 0.28 | 3 |
| 9 | A-1 | 3-2 | 12 | 22 | EA | 150 | 5 | 0.28 | 1 |
| 10 | A-1 | 3-2 | 12 | 25 | EA | 150 | 5 | 0.28 | 1 |

TABLE 2-continued

| Sample No. | Emulsion Composition | Lubricant Species | Lubricant mg/m$^2$ | Transfer speed mm/sec | Developer | Sensitivity | DQ | Kinetic friction coefficient | Abrasion (among 100 pages) |
|---|---|---|---|---|---|---|---|---|---|
| 15 | A-1 | 2-6 | 12 | 25 | EA | 150 | 5 | 0.35 | 5 |
| 16 | A-1 | 2-6 | 25 | 25 | EA | 150 | 5 | 0.33 | 3 |
| 17 | A-1 | 3-2 | 5 | 25 | EA | 150 | 5 | 0.33 | 4 |
| 18 | A-1 | 3-2 | 25 | 25 | EA | 150 | 5 | 0.32 | 0 |

As apparent from the Table, in case that the photographic material having kinetic friction coefficient of 0.35 or less is processed by developer of developing agent represented by formula (A), scratch defects reduce to non-problematic level.

Example 2

Example Concerning to Impedance of Film Material (Dispersion liquid of conductive particle P1)

A 10% 1,1,2,2-tetrachloroethane solution of (NP $(NHC_6H_5)_{1.6}(NHC_6H_4)SO_3H)_{0.4})n$: (N 545) was sprayed by means of a spray drying method, and then collected as a powder. With regard to the resulting powder, an average particle size was 0.15 $\mu$m, the specific gravity was 1.25 and the specific volume resistance was $2.3\times10^4$ Ωcm. The above-mentioned conductive powder was dispersed in water to a density of 8 wt %.

(Dispersion liquid of conductive particle P2)

Sixty five g of stannic chloride hydrate was uniformly dissolved in 2000 cc of water. Next, the resulting solution was boiled so as to obtain a co-precipitant. The resulting precipitant was taken up from decantation, and then the precipitation was washed for numerous times with distilled water. In the distilled water wherein the precipitation was washed, silver nitrate was dropped for confirming that there is no reaction of chlorine ions. Aforesaid precipitant was added to 1000 cc of distilled water and dispersed. Following this, the total amount was arranged to 2000 cc of solution. In addition, 40 cc of 30% aqueous ammonia was added to the aforesaid solution. When the resulting solution was heated in a water bath, $SnO_2$ sol solution is generated.

When aforesaid solution is used for a coating composition, the density is condensed while spraying ammonia to aforesaid sol solution to be used. In addition, with regard to the specific volume resistance of the particles contained in aforesaid sol solution, a thin layer was formed on a silica glass by the use of a sol solution, and a value measured by the use of a four probe method of resistivity measurement was defined to be the specific volume resistance value. The specific volume resistance value was $3.4\times10^5$ Ωcm.

(Dispersion liquid of conductive particle P3)

Sixty five g of stannic chloride hydrate and 1.0 g of antimony trichloride were dissolved in 2000 cc of an aqueous water for obtaining a uniform solution. Next, the resulting solution was boiled so as to obtain a co-precipitant. The resulting precipitant was taken up from decantation, and then the precipitation was washed for numerous times with distilled water. In the distilled water wherein the precipitation was washed, silver nitrate was dropped for confirming that there is no reaction of chlorine ions. Aforesaid precipitant was added to 1000 cc of distilled water and was dispersed. Following this, the total amount was arranged to 2000 cc. In addition, 40 cc of 30% aqueous ammonia was added to the aforesaid solution. When the resulting solution was heated in a water bath, $SnO_2$ sol solution is generated.

Aforesaid sol solution was sprayed to an electric furnace heated at 400° C. so that a conductive powder was synthesized. The resulting powder was molded by means of a tablet molder. Following this, the specific volume resistance measured by the four probe method of the resistivity measurement was $1.5\times10^1$ Ωcm.

The above-mentioned conductive powder was dispersed in an aqueous ammonia having pH of 10 to a density of 8 wt %.

(Preparation of a support for a silver halide photographic light-sensitive material)

Both surfaces of a 100 $\mu$m thickness polyethylene terephthalate film, after being biaxially orientated and heat-fixed, were subjected to corona discharge with 8 W min./m$^2$. On one surface thereof, as described in JP-A 59-19941, the following subbing coating composition B-1 was coated as a subbing layer B-1 in such a manner as that its dry layer thickness would be 0.8 $\mu$m, after being dried at 100° C. for one minute. In addition, on the layer opposite the subbing layer B-1 on aforesaid polyethylene terephthalate film, as described in JP-A 59-77439, the following subbing coating composition B-2-1 was coated as subbing layer B-2. This layer was also dried at 110° C. for one minute.

Subbing Layer No. 1

Subbing Coating Composition B-1

| | |
|---|---|
| Copolymer latex solution composed of 30 wt % of butylacrylate, 20 wt % of t-butylacrylate; 25 wt % of styrene and 25 wt % of 2-hydroxyethylacrylate (the solid portion was 30%) | 270 g |
| Compound A | 0.6 g |
| Hexamethylene-1,6-bis (ethylene urea) | 0.8 g |
| Water was added to make 1 liter. | |

Subbing Coating Composition B-2-1

| | |
|---|---|
| Copolymer latex solution composed of 40 wt % of butylacrylate, 20 wt % of styrene and 40 wt % of glycidyl acrylate (the solid portion was 30%) | 23 g |
| Conductive Dispersant P2 | 415 g |
| Polyethylene glycol (the molecular weight was 600) | 0.00012 g |
| Water | 568 g |

Subbing Layer No. 2

In addition, the above-mentioned subbing layers B-1 and B-2-1 were subjected to corona discharge at 8 W min./m$^2$, and then, the following coating composition B-3 was coated in such a manner that the dry layer thickness was 0.1 $\mu$m. This layer was dried at 100° C. for one minute.

Subbing Coating Composition B-3

| | |
|---|---|
| Gelatin | 10 g |
| Surfactant A | 0.4 g |
| 1,3,5-Triacryloyl-hexahydro-S-triazine | 0.1 g |
| Silica particles (average particle size: 3 μm) | 0.1 g |
| Water was added to make 1 liter. | |

(Support 2)

Preparation condition of the sample was the same as the Support 1 except that the subbing coating composition B-2-5 was employed in place of the subbing coating composition B-2-1.

Subbing Coating Composition B-2-5

| | |
|---|---|
| Copolymer latex solution composed of 40 wt % of butylacrylate, 20 wt % of styrene and 40 wt % of glycidyl acrylate (the solid portion was 30%) | 27 g |
| Conductive Dispersant P2 | 80 g |
| Polyethylene glycol (the molecular weight was 350) | 0.0001 g |
| Water | 700 g |

(Support 3)

Preparation condition of the sample was the same as the Support 1 except that the subbing coating composition B-2-11 was employed in place of the subbing coating composition B-2-1. Subbing coating composition B-2-11

| | |
|---|---|
| Copolymer latex solution composed of 40 wt % of butylacrylate, 20 wt % of styrene and 40 wt % of glycidyl acrylate (the solid portion was 30%) | 27 g |
| Conductive Dispersant P2 | 700 g |
| Polyethylene glycol (the molecular weight was 600) | 1.6 g |
| Water | 800 g |

(Support 4)

Preparation condition of the sample was the same as the Support 1 except that the subbing coating composition B-2-12 was employed in place of the subbing coating composition B-2-1.

Subbing Coating Composition B-2-12

| | |
|---|---|
| Copolymer latex solution composed of 40 wt % of butylacrylate, 20 wt % of styrene and 40 wt % of glycidyl acrylate (the solid portion was 30%) | 23 g |
| Conductive Dispersant P2 | 620 g |
| Polyethylene glycol (the molecular weight was 600) | 1.55 g |
| Water | 690 g |

(Support 5)

Preparation condition of the sample was the same as the Support 1 except that the subbing coating composition B-2-14 was employed in place of the subbing coating composition B-2-1.

Subbing Coating Composition B-2-14

| | |
|---|---|
| Copolymer latex solution composed of 40 wt % of butylacrylate, 20 wt % of styrene and 40 wt % of glycidyl acrylate (the solid portion was 30%) | 27 g |
| Conductive Dispersant P1 | 82 g |
| Polyethylene glycol (the molecular weight was 600) | 0.00012 g |
| Water | 680 g |

(Support 6)

Preparation condition of the sample was the same as the Support 1 except that the subbing coating composition B-0-1 was employed in place of the subbing coating composition B-2-1.

Subbing Coating Composition B-0-1

| | |
|---|---|
| Copolymer latex solution composed of 40 wt % of butylacrylate, 20 wt % of styrene and 40 wt % of glycidyl acrylate (the solid portion was 30%) | 270 g |
| Water to make 1 liter. | |

(Support 7)

Preparation condition of the sample was the same as the Support 1 except that the subbing coating composition B-0-3 was employed in place of the subbing coating composition B-2-1. Prepared sample is tinged slightly gray.

Subbing Coating Composition B-0-3

| | |
|---|---|
| Copolymer latex solution composed of 40 wt % of butylacrylate, 20 wt % of styrene and 40 wt % of glycidyl acrylate (the solid portion was 30%) | 27 g |
| Conductive Dispersant P3 | 45 g |
| Water | 750 g |

(Support 8)

Sample was prepared in the same way as Support 1 except that an anti-static layer of Example was employed in place of the subbing coating composition B-2-1.

For the 8 samples thus prepared, the emulsion layer and the protective layer employed in Example 1 were coated on the side where the subbing coating composition B-1 was coated, and the backing layer and the backing protective layer were coated on the reverse side in the same way.

Absolute value of impedance was measured for the obtained samples in the following way. Measurement method of the absolute value of the impedance When impedance was measured, Precision LCR meter HP4284A and HP16451 produced by Yokogawa Hewlett Packard (hereinafter, referred to as YHP) were combined to be used.

Under atmosphere of 23° C. and 20% RH, the absolute value of the impedance of the film material was measured by means of a cavity method. With regard to the measurement of the cavity method, see an electrode non-contact method described in the operation manual (the parts number was 16451-97000, printed in December, 1989) of HP16451B. Using an electrode A wherein the diameter of the main electrode was 3.8 cm, the sample was cut to a square of 5.5×5.5 cm. The dispersion layer having the conductive particles was turned upward and measured. The result is shown in Table 4.

TABLE 3

| Sample No. | Emulsion Composition | Support | Impedance ($\times 10^4$) | Content of elecro-conductive particle (vol %) | Transfer speed (mm/sec) | Developer |
|---|---|---|---|---|---|---|
| 21 | A-1 | 1 | 255 | 40 | 25 | EA |
| 22 | A-1 | 2 | 100 | 10 | 25 | EA |
| 23 | A-1 | 3 | 45 | 45 | 25 | EA |
| 24 | A-1 | 4 | 51 | 50 | 25 | EA |
| 25 | A-1 | 5 | 55 | 10 | 25 | EA |
| 26 | A-1 | 6 | 30 | 0 | 25 | EA |
| 27 | A-1 | 7 | 34 | 5 | 25 | EA |
| 28 | A-1 | 8 | 215 | 50 | 25 | EA |
| 29 | A-1 | 1 | 255 | 40 | 15 | EA |
| 30 | A-1 | 6 | 30 | 0 | 15 | EA |
| 31 | A-1 | 1 | 255 | 40 | 13 | EA |
| 32 | A-1 | 6 | 30 | 0 | 13 | EA |
| 33 | A-1 | 1 | 255 | 40 | 25 | HQ |
| 34 | A-1 | 6 | 30 | 0 | 25 | HQ |
| 35 | A-1 | 1 | 255 | 40 | 13 | HQ |
| 36 | A-1 | 6 | 30 | 0 | 13 | HQ |

TABLE 4

| Sample No. | Sensitivity | DQ | Abrasion (among 100 pages) |
|---|---|---|---|
| 21 | 100 | 5 | 0 |
| 22 | 100 | 5 | 1 |
| 23 | 100 | 5 | 5 |
| 24 | 100 | 5 | 4 |
| 25 | 100 | 5 | 5 |
| 26 | 100 | 5 | 52 |
| 27 | 100 | 5 | 43 |
| 28 | 100 | 5 | 0 |
| 29 | 100 | 5 | 1 |
| 30 | 100 | 5 | 32 |
| 31 | 100 | 5 | 5 |
| 32 | 100 | 5 | 10 |
| 33 | 100 | 5 | 42 |
| 34 | 100 | 5 | 52 |
| 35 | 100 | 5 | 12 |
| 36 | 100 | 5 | 15 |

Results shown in Table 4 demonstrate that an image forming method free from abrasion by processing the photosensitive material having impedance of $4\times10^5$ to $10^{22}$ Ω with the developer employing developing agent represented by formula (A)

The present invention provides an image forming method which is difficult to form abrasion damage when employed in the way of conveying with high speed at the exposing step, and results improving production performance at the exposing step.

Disclosed embodiment can be varied by a skilled person without departing from the spirit and scope of the invention.

What is claimed is:

1. An image forming method of a silver halide photographic light-sensitive material comprising a light-sensitive silver halide emulsion layer provided on a support, comprising steps of exposing the silver halide photographic light-sensitive material to a laser beam light, while said silver halide photographic light-sensitive material is conveyed with rollers at 15 to 100 mm/sec., processing the exposed silver halide photographic light-sensitive material with a developer composition containing a developing agent represented by formula (A) wherein the silver halide photographic light-sensitive material contains at least an organic contrast enhancing agent, the impedance of at least one side of said silver halide photographic light-sensitive material is from $4\times10^5$ to $10^{20}$ Ω, Formula (A)

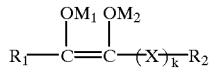

wherein, $R_1$ and $R_2$ each represent a substituted or unsubstituted alkyl group; a substituted or unsubstituted amino group, a substituted or unsubstituted alkoxy group, a substituted or unsubstituted alkylthio group; $R_1$ and $R_2$ may form a ring structure with each other; k represents 0 or 1, and when k is 1, X represents —CO— or —CS—; $M_1$ and $M_2$ each represent a hydrogen atom or an alkali metal.

2. The image forming method of claim 1 wherein the kinetic friction coefficient of an emulsion side of said silver halide photographic light-sensitive material is 0.10 to 0.35.

3. The image forming method of claim 2 wherein an outermost layer of the emulsion side contains a lubricant.

4. The image forming method of claim 3 wherein the lubricant is alkylpolysiloxane.

5. The image forming method of claim 1 wherein the rollers are composed of gum.

6. The image forming method of claim 1 wherein the silver halide photographic light-sensitive material comprises polyhydroxybenzene compound.

7. The image forming method of claim 1 wherein the silver halide photographic light-sensitive material comprises an electro-conductive layer.

8. The image forming method of claim 7 wherein the electro-conductive layer is provided adjacent to the support.

9. The image forming method of claim 1 wherein contrast enhancing organic agent is hydrazine derivatives or tetrazolium compounds.

* * * * *